US005396965A

United States Patent [19]

Hall et al.

[11] Patent Number: 5,396,965

[45] Date of Patent: Mar. 14, 1995

[54] DOWN-HOLE MUD ACTUATED HAMMER

[75] Inventors: David R. Hall; David S. Pixton; Yu Xiang-Guang, all of Provo, Utah

[73] Assignee: Novatek, Provo, Utah

[21] Appl. No.: 299,267

[22] Filed: Jan. 23, 1989

[51] Int. Cl.[6] ..... B25D 17/14

[52] U.S. Cl. ..... 173/73; 173/78

[58] Field of Search ..... 173/73, 78, 80, 134, 173/135

[56] References Cited

U.S. PATENT DOCUMENTS

| | | | |
|---|---|---|---|
| 1,892,517 | 12/1932 | Pennington . | |
| 2,620,162 | 12/1952 | Pennington | 255/3 |
| 2,758,817 | 8/1956 | Bassinger | 255/4.4 |
| 2,764,130 | 9/1956 | Bassinger | 121/16 |
| 2,774,334 | 12/1956 | Cline, Jr. | 121/28 |
| 2,800,884 | 7/1957 | Mori | 173/78 |
| 2,943,603 | 7/1960 | Bassinger | 121/30 |
| 3,101,796 | 8/1963 | Stall et al. | 173/73 |
| 3,105,559 | 10/1963 | Collier et al. | 173/15 |
| 3,162,251 | 12/1964 | Bassinger | 173/73 |
| 3,167,136 | 1/1965 | Cook | 173/73 |
| 3,180,434 | 4/1965 | Vincent | 173/73 |
| 3,307,639 | 3/1967 | Wilder et al. | 173/136 |
| 3,322,207 | 5/1967 | Foster | 173/73 |
| 3,327,790 | 6/1967 | Vincent et al. | 173/73 |
| 3,387,671 | 6/1968 | Collier | 173/73 |
| 3,410,353 | 11/1968 | Martini | 173/73 |
| 3,491,838 | 1/1970 | Wilder et al. | 173/73 |
| 3,602,317 | 8/1971 | Scroggins | 173/73 |
| 3,612,191 | 10/1971 | Martini | 173/73 |
| 3,712,387 | 1/1973 | Vincent et al. | 173/73 |
| 3,768,576 | 10/1973 | Martini | 173/73 |
| 3,970,152 | 7/1976 | Harris et al. | 173/15 |
| 4,044,844 | 8/1977 | Harris et al. | 173/73 |
| 4,729,440 | 3/1988 | Hall | 175/107 |
| 4,732,364 | 3/1988 | Seger et al. | 251/368 |
| 4,738,322 | 4/1988 | Hall et al. | 175/329 |

OTHER PUBLICATIONS

R. P. Vincent, L. B. Wilder, "Tool boosts drilling in hard formations," *Oil and Gas Journal,* pp. 74–78 (Mar. 31, 1969).

"New Percussion Drill Shows Great Promise," *The Petroleum Engineer,* pp. B32–B34 (Jul. 1957).

W. H. Cline, Jr., "Progress Report on a Fluid Actuated Rotary Percussion Engine," Presented at the Petroleum Mechanical Engineering Conference Sponsored by the American Society of Mechanical Engineers, Petroleum Division (Sep. 28–30, 1953).

R. Brown, "The Bassinger Rotary Percussion Drill," *The Petroleum Engineer,* pp. B42–B52 (Dec. 1950).

W. E. Harpst, E. E. Davis, "Experiments in Rotary Percussion Drilling," *The Oil and Gas Journal,* pp. 182–187 (Mar. 17, 1949).

"Executive Summary," courtesy Amoco (date unknown).

*Primary Examiner*—Willmon Fridie

*Attorney, Agent, or Firm*—Willian Brinks Hofer Gilson & Lione

[57] ABSTRACT

Improvements in down-hole mud actuated hammers are disclosed. According to its broadest aspect the invention is a down-hole mud actuated hammer for use in a drill string, which includes a housing with an upper end having means for connecting to the drill string. A throat is located within the housing which throat includes a main flow passage to allow high pressure drilling mud to pass therethrough. A piston is provided which is adapted to move axially within the housing means to thereby reciprocate between an up position and a down position. The piston is moved between the up and down position by a minor portion of the high pressure mud which portion passes from the main flow passage into at least one piston actuating chamber. This minor portion of mud is exhausted from the piston actuating chamber to a low pressure region out of the housing without being returned to the main flow passage.

59 Claims, 14 Drawing Sheets

DOWN-HOLE MUD ACTUATED HAMMER

BACKGROUND OF THE INVENTION

The present invention relates to the field of percussive tools used in drilling. More particularly, the invention relates to the field of down-hole hammers which are actuated by the pressure of the drilling fluid, i.e. drilling mud. Generally, these tools are known in the petroleum drilling industry simply as "down-hole mud hammers".

Typically, down-hole hammers are used to effect periodic mechanical impacts upon a drill bit. Through this percussion, the drill string is able to more effectively apply drilling power to the formation, thus aiding penetration into the formation.

Previous attempts to provide hammering motion in a drill string using power sources other than drilling mud have included use of high pressure air (see, for example U.S. Pat. Nos. 4,446,929, 4,084,646, 4,054,180); electricity (see, for example U.S. Pat. No. 3,343,611); and spontaneously combusting fuels (see, for example U.S. Pat. No. 4,583,601). However, the use of such power sources either restricts the useful application of the tool to situations where cuttings may be removed by air or other gases; or requires separate piping or cabling be added to the drill string to conduct the alternative power sources to the hammer.

To counteract the first of these limitations, some have proposed using air to produce the hammering motion and then using mud or another fluid to flush the hole (or vice versa, in the case of European Pat. #0,233,038). However, this approach still requires separate piping. In addition, it requires that special seals and exclusionary devices be employed to separate the air chambers from the mud passageways. Such complexities add an increased failure potential and undesirable expense to the drilling process without achieving substantial gains in drilling rate.

Generally, mud actuated down-hole hammers convert a portion of the power resident in common drilling fluid into the periodic mechanical impacts upon the drill bit. Among the many attempts to increase down-hole drilling effectiveness, a successful down-hole mud hammer would provide particular advantages.

First, the mud hammer is able to complement other forms of drilling, such as conventional rotary practice. Hence, its effects on the overall rate of drilling are additive to those of existing technologies, rather than superceding.

Second, as its name implies, the mud hammer is able to operate on mud, i.e. common drilling fluid, which is used to flush cuttings out of the hole. Drilling mud is currently used for the majority of drilling situations. Consequently, the equipment and procedures are already in place for the supply and circulation of drilling mud. Thus, the mud hammer is compatible with existing drilling practice and requires essentially no adaptation for its use on a conventional drilling rig.

For the above reasons, the use of mud to actuate a down-hole hammer is advantageous. However, using drilling mud as an actuating fluid does not come without problems. Although several attempts have been made to achieve mud actuation of a hammer element, none of these designs are known to have been commercially successful. The problems with these designs are believed to be related to two of the physical properties of drilling mud, namely its non-compressibility, and its high abrasiveness.

Drilling mud is an incompressible fluid. Consequently, drilling mud is subject to severe pressure transients if its flow is stopped suddenly. Many prior mud hammer designs utilized the inertia of the moving column of fluid in the drill string to drive the hammer element towards the bit (see, for example Wolski U.S. Pat. No. 699,273; Zublin U.S. Pat. No. 1,861,042; Bassinger U.S. Pat. Nos. 2,764,130, 2,758,817, and 2,756,723). These designs were thus hampered by the extreme dynamic pressure loading caused by the "water hammer" effect, i.e. the condition wherein high pressure transients are created as a result of the sudden halting of a quantity of water. This condition is particularly destructive when high fluid flow rates, such as those encountered in normal oil well drilling operations, are involved. In the article "The Bassinger Rotary Percussion Drill," *The Petroleum Engineer,* December 1950, pp. B42–B52, Robinson Brown records that rig vibration and caving of hole walls are among the problems caused by the stopping and starting of the fluid column. Pressure transients developed in this way are also destructive in that they increase the flow potential, and thereby the erosion potential, across valve members. These pressure transients also contribute to extreme dynamic loading of these valving components.

A few mud hammer designs have been proposed to alleviate the water hammer problems by adding a separate leakage pathway to the tool (See, U.S. Pat. No. 2,774,334; U.S. Pat. No. 3,970,152; and U.S. Pat. No. 3,491,838). Although these designs have to some extent reduced the problems of pressure transients, the complete problems related to the incompressibility of mud have not been solved.

An additional problem seen by these earlier designs for mud hammers has been caused by the high abrasiveness of drilling mud. In particular, the erosion of critical tool surfaces has been a significant factor in limiting the service life of many mud hammers. In response to this erosion problem, Harris (U.S. Pat. Nos. 4,044,844 and 3,970,152) used tungsten carbide wear surfaces in critical erosion areas in an attempt to retard erosion. However, abrasive wear still prevented the commercial success of various designs.

SUMMARY OF THE INVENTION

The present invention is directed to improvements in down-hole mud actuated hammers.

According to its broadest aspect the invention is a down-hole mud actuated hammer for use in a drill string, which includes a housing with an upper end having means for connecting to the drill string. A throat is located within the housing which throat includes a main flow passage to allow high pressure drilling mud to pass therethrough. A piston is provided which is adapted to move axially within the housing means to thereby reciprocate between an up position and a down position. The piston is moved between the up and down position by a minor portion of the high pressure mud which portion passes from the main flow passage into at least one piston actuating chamber. This minor portion of mud is not returned to the main passage, but instead is exhausted from the piston actuating chamber to a low pressure region out of the housing.

In accordance with one preferred embodiment of the present invention, the hammer includes a shank which is slidably fitted within the lower end of the housing. The upper end of the shank is provided with impact surfaces. The lower end of the shank is adapted to connect to the drill string, preferably the bit. The piston in this preferred embodiment, includes impact surfaces at its lower end which are adapted to strike the impact surfaces of the shank when the piston is in the down position. This preferred embodiment also includes an upstroke chamber adapted so that when high pressure mud flows into the upstroke chamber, the high pressure mud contacts an upward actuating surface of the piston and thereby exerts an upward force on the piston means. A downstroke chamber is also provided which is adapted so that when high pressure mud flows into the downstroke chamber, the high pressure mud contacts a downward actuating surface of the piston means to thereby push the piston downward to the down position. A sliding valve is further provided which is adapted to slide between a first position wherein high pressure mud from the main flow passage is allowed to flow into the downstroke chamber, and a second position wherein high pressure mud is exhausted from the downstroke chamber.

In accordance with another preferred embodiment, the piston is disposed concentrically around the throat means and is fixedly attached thereto. The sliding valve is disposed concentrically around the piston with a gap therebetween to create an annulus into which mud can flow.

In accordance with yet another preferred embodiment, the down-hole mud actuated hammer further includes a pressure activated shut-off means. The means includes a shut-off valve adapted to slide between a first position which closes the exhaust passage to thereby prevent exhausting of the high pressure mud in the downstroke chamber; and a second position which opens the exhaust passage. The shut-off means also includes biasing means for biasing the valve toward the first position with a predetermined biasing force. There is also provided a shut-off valve actuating chamber wherein mud from the drill string contacts at least one actuating surface to thereby create a force opposing the predetermined biasing force. The opposing force is designed to be sufficient to push the shut-off valve into the second position when the mud in the drill string possesses a predetermined pressure.

It is noted that as used in the specification and claims appended hereto the terms "mud" and "drilling mud" are intended to refer to typical as well as atypical liquids used in drilling operations. Typical drilling mud is a water suspension of bentonite clay with various additives used depending on the specifications of the hole to be drilled. Other types of mud can also be used including those which are oil based. In certain applications, water can be used as the drilling mud.

It is also noted that, because the mud actuated hammer of the present invention can be used in drilling vertical and non-vertical holes, the terms "lower," "bottom," and the like are used in a relative sense and are intended to refer to the portion which is closer to the drill bit. Likewise, the terms "upper," "top," and the like are also used in a relative sense and are intended to refer to elements which are farther from the drill bit.

It is further noted that, when percentages of mud flow are mentioned in this specification and the appended claims, the percentages refer to a volume percentage averaged over at least one complete percussive cycle of the mud hammer.

The present invention, together with attendant objects and advantages, will be best understood with reference to the detailed description below read in conjunction with the accompanying drawings.

DETAILED DESCRIPTION OF THE PREFERRED EMBODIMENTS

Figure 1:
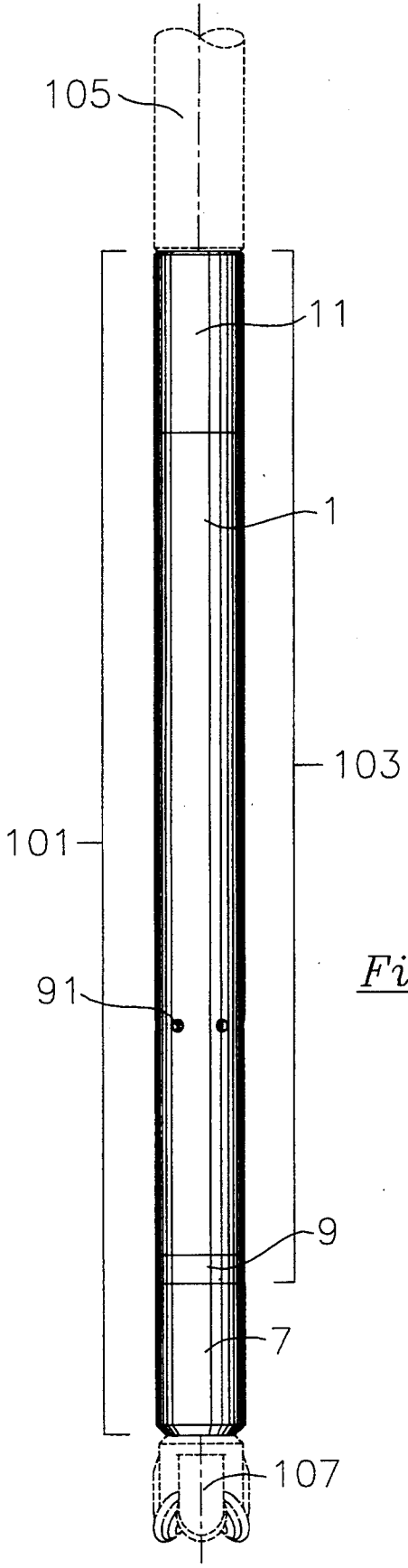
FIG. 1 is a perspective view of the most preferred embodiment of the present invention.

Referring to the drawings, FIG. 1 is a view from the side of the down-hole mud actuated hammer 101 of the most preferred embodiment of the present invention. From the outside, the three basic components of the hammer's housing 103 are visible. The top section 11 of the housing is referred to as the backhead. This section includes means for attaching the hammer 101 to a drill string 105. Typically, the backhead will be threaded onto the drill string.

The central section 1 of the housing is threaded onto the backhead 11. The bottom section 9 of the housing is the bit retainer sub.

Extending below the bit retainer sub is the shank 7. As can be seen, the shank includes means for attachment to the drill string. As can be seen, the shank 7 is preferably attached directly to the drill bit 107. In this way, the impact force generated by the hammer is not dampened by a tool in between the hammer and the drill bit. Alternatively, a tool can be inserted in between. It is noted that the drill bit is considered part of the drill string.

Preferably, the bit used with the hammer of the present invention is a rotary bit such as the roller cone bit shown here. Alternatively, the hammer can be used with other types of bits, such as shear or drag-type rotary bit.

In still other embodiments the hammer can be used as a jarring device or a down-hole pile driver.

Exhaust ports 91 can be seen in the central section 1 of the housing. Preferably, there are 6 such exhaust ports equally spaced around the housing.

Figure 2:
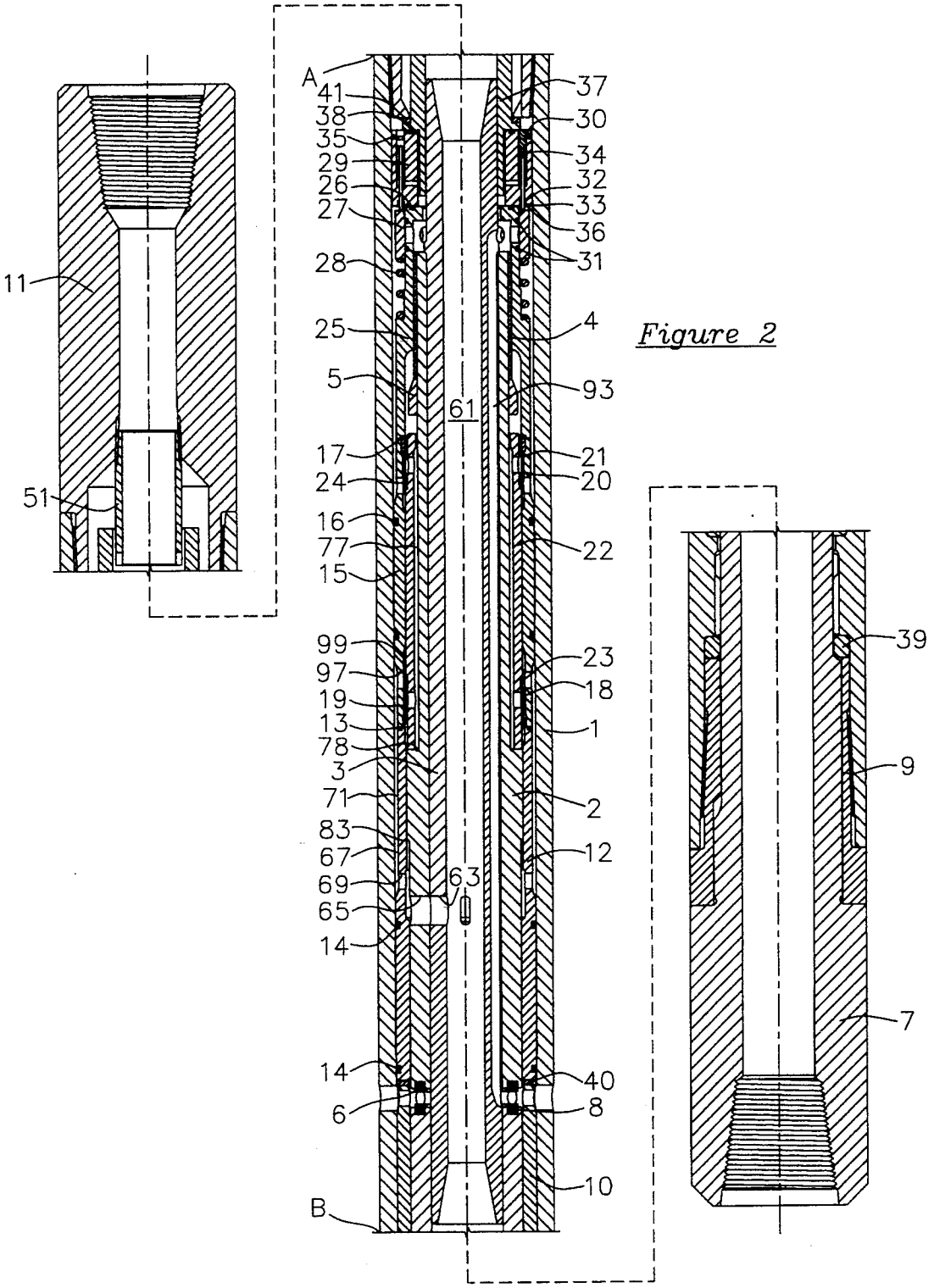
FIG. 2 is a vertical cross-sectional view of the preferred embodiment shown in FIG. 1.
Figure 3:
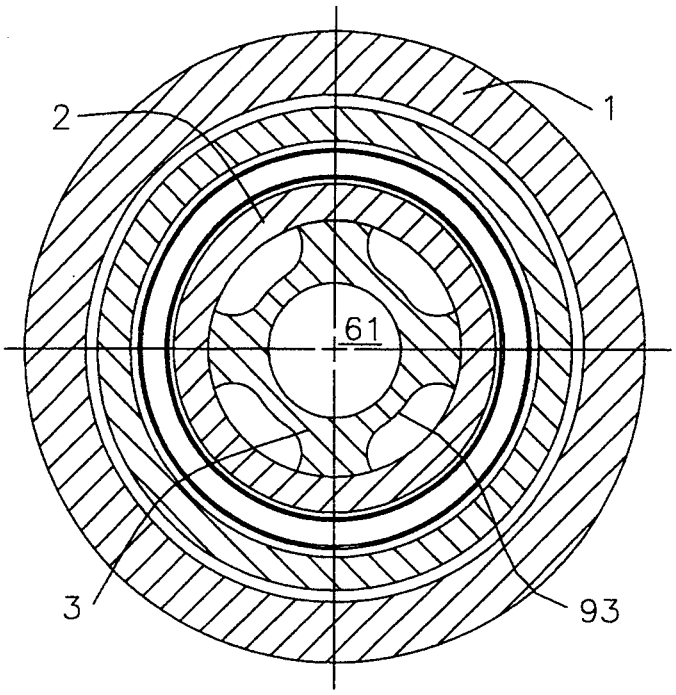
FIG. 3 is a cross-sectional view taken along line 3—3 of FIG. 2.

FIG. 2 is a vertical cross-sectional view taken along a vertical axis of FIG. 1. For convenience in viewing, FIG. 2 has been broken at points A and B. FIGS. 3–7 are horizontal cross-sectional views taken the indicated points. Also, for convenience, the cross-section has been taken slightly off-center so as to show features, such as the exhaust passages 93, which are actually symmetrically disposed about the central axis.

Referring to FIGS. 2–7, several generally tubular parts are fit concentrically within the central section of housing 1. The centermost part is the throat 3. The throat 3 includes a central passage 61 through which the high pressure drilling mud supplied to the drilling string passes.

The throat, as well as the other pieces of the hammer unless otherwise indicated, is preferably made from AISI 4145 steel. Preferably, the surfaces of the various elements which come into sliding contact with other surfaces are coated with a coating of a cemented carbide such as cobalt-bonded tungsten carbide to reduce wear. Also, with the exceptions noted below, the surfaces which are used to seal drilling mud in and out of passages and chambers are preferably coated with tungsten carbide.

In addition to the central passage 61, the throat also includes four exhaust passages 93 running from just above to just below the piston 2. The throat also includes four supply ports 63 through which a minor portion of the high pressure drilling mud can exit the main passageway 61.

It is important to note that the portion of high pressure drilling mud which exits the central passage 61 through the supply ports 63 is a minor portion, i.e. less than 50 percent, of the total flow of drilling mud entering the central passage from the drill string above. Preferably, the portion of high pressure drilling mud passing through the supply ports 63 is between about 5 and about 35 percent, most preferably between about 10 and about 20 percent.

It is also important to note that the minor portion of high pressure drilling mud which exits the central passage through the supply ports 63 is not returned to the main passage. Instead, as will be explained more fully below, the mud is ultimately exhausted to a lower pressure region outside of the drill string.

One way to conceptualize this basic flow path of the present invention is to think of it as a parallel mud flow circuit, i.e. the majority of the mud flowing through the drill string is not interrupted by the mud hammer. Instead, the column of high pressure drilling mud is simply split, with a minor portion being used to power the mud hammer after which it is exhausted.

In contrast, previous down hole mud hammers have operated hydraulically "in series" with the bit, i.e. the previous designs have relied on the interruption of the flow of the major portion. Such a "series" arrangement provides just one pathway of flow wherein all of the fluid flowing through one element flows through the others. From a drilling standpoint, this offers the advantage that all the flow travelling down the drillstring also travels through the bit, providing a maximal amount of flow to flush the hole bottom. However, in a serial arrangement, the mud pressure is sequentially dropped across each of the elements in series. Consequently, the hydraulic pressure available for jetting at the bit is decreased, and the control of the mud hydraulics by rig personnel becomes complicated.

Another disadvantage of using a serial arrangement is that since the hammer is an oscillatory element driven by fluid flow, the fluid actuating the hammer must experience velocity changes as it performs its task. These velocity changes, coupled with the incompressibility of the mud can cause serious pressure transients within the fluid, i.e. the "water hammer" effect referred to above.

In the present invention, the mud used by the device flows in a circuit which is parallel to that serving the rest of the drill string. Thus, the bit "sees" the same pressure as the rest of the drill. This mode of operation affords several benefits. First, jetting pressure at the bit is allowed to remain high, allowing the use of drilling mechanisms which depend on high jet velocity.

Second, control of the tool hydraulics may be accomplished by regular rig equipment and personnel, since the pressure present at the bit is simply equal to the measured pump output pressure minus the standard piping head loss. The pressure actually appearing at the bit does not depend on the operation of a varying in-line element. By way of comparison, the complexity of control of other in-series tools, such as down-hole positive displacement motors, is a common complaint.

Third, the mud hammer of the present invention, which has a parallel mud flow circuit, is more dependent on pressure than flow. Therefore, assuming appropriate bit pressures are available and proper tool design, potentially less flow must travel through the hammer chambers. If this is the case, when the actuating fluid experiences inevitable velocity changes during the reciprocation of the hammer, smaller momentum effects are encountered, thereby reducing damaging pressure transients.

Fourth, in the event the tool ceases to reciprocate, flow is still able to pass through the bit and flush the hole. This is a particularly important feature, since it allows conventional drilling to continue until the drillstring may be conveniently retrieved from the hole.

In basic terms, the implementation of the parallel flow path of the present invention is accomplished in the following way. First all of the incoming flow is ported directly through the hammer element. Only a minor portion of the total flow is removed and ported to the hammer actuation chambers through supply passageways. This minor portion is then exhausted after use into the low pressure region (the borehole annulus) beyond the bit.

Referring again to the drawings, concentrically disposed around the throat 3 is the piston 2. Preferably, the piston is fixedly attached to the throat, such as by a heat shrink fit. When this is done, the throat is made to reciprocate with the piston. A throat bearing sleeve 37 is included for the upper end of the throat 3 to slide in. In a less preferred alternative embodiment, the throat can be fixedly attached to the housing.

The piston 2 includes four supply ports 65 which coincide with the supply ports 63 in the throat 3. At the point of the supply ports 65 and just above, the piston 2 has a reduced outside diameter. As such, an annular chamber 67 is created between the supply sleeve 12 and the piston 2. Consequently, when high pressure mud enters this chamber 67, it exerts a force on the top surface 83 on the piston. An upward force is thereby exerted on the piston. For convenience, the chamber 67 is hereafter referred to as the "upstroke chamber."

As can be seen, the supply sleeve 12 includes a supply port 69. The middle section of the housing 1 has a section 121 with an increased inside diameter to thereby create an annular chamber 71 between the supply sleeve 12 and the middle section 1 of the housing. This chamber or passage 71 is supplied with high pressure mud which passes through the supply ports 63, 65, and 69. Two elastomeric seals 13 and 14 are included within recesses of the supply sleeve 12. These elastomeric seals, as well as the other elastomeric seals shown in the depicted embodiment, are preferably made of a carboxylated nitrile elastomer, such as that sold by Parker-Hannifin Corp. under the designation "Nitroxile".

Fitted above the supply sleeve 12 is a valve sleeve 15. Preferably, this valve sleeve is made from cemented tungsten carbide. The valve sleeve's lower portion has a diameter which matches that of the upper portion of the supply sleeve to thereby extend the chamber 71. There are 9 supply ports 97 included around the valve sleeve. At the point of the port 97 and just above, the valve sleeve has an increased inside diameter to thereby create an annular chamber 99 into which high pressure mud is continuously supplied.

Fitting concentrically within the valve sleeve 15 is the sliding valve 22. As can be seen, the gap between the sliding valve 22 and the piston 2 creates a chamber 77. When high pressure mud is allowed into the chamber 77, a downward force is exerted on the piston 2. Accordingly, the chamber 77 can be referred to as the downstroke chamber. Because the net surface area at shoulder 78 is greater than the surface area at 83, the downward force is greater than the upward force. As a result, the piston is pushed downward when high pressure mud is supplied to both chambers simultaneously.

Figure 8A:
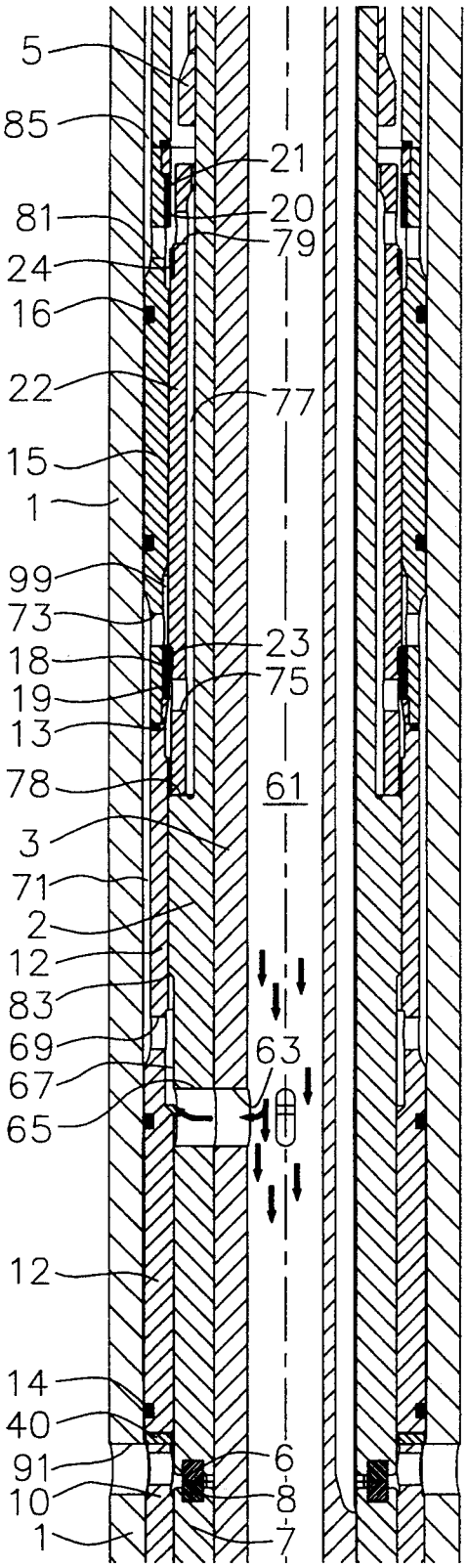
FIGS. 8*a*–8*d* are a set of enlarged partial cross-sectional views illustrating the operation of the piston and valve in the percussion cycle.
Figure 8B:
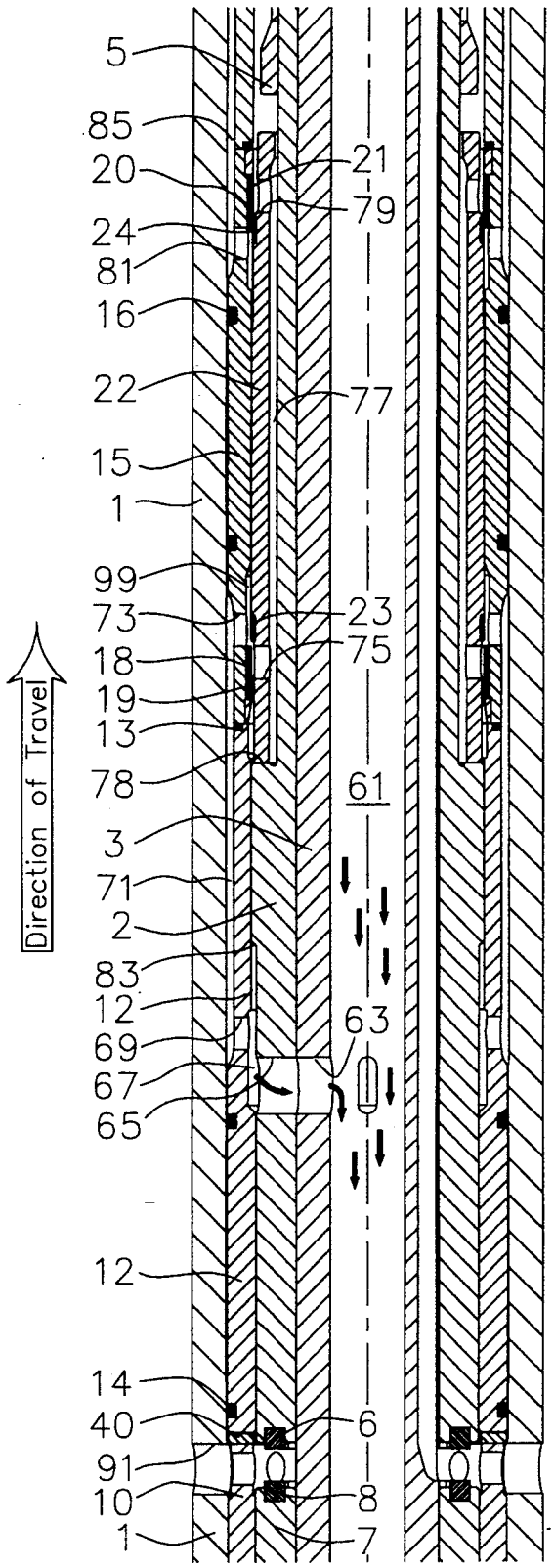
Figures 8C, 8D:
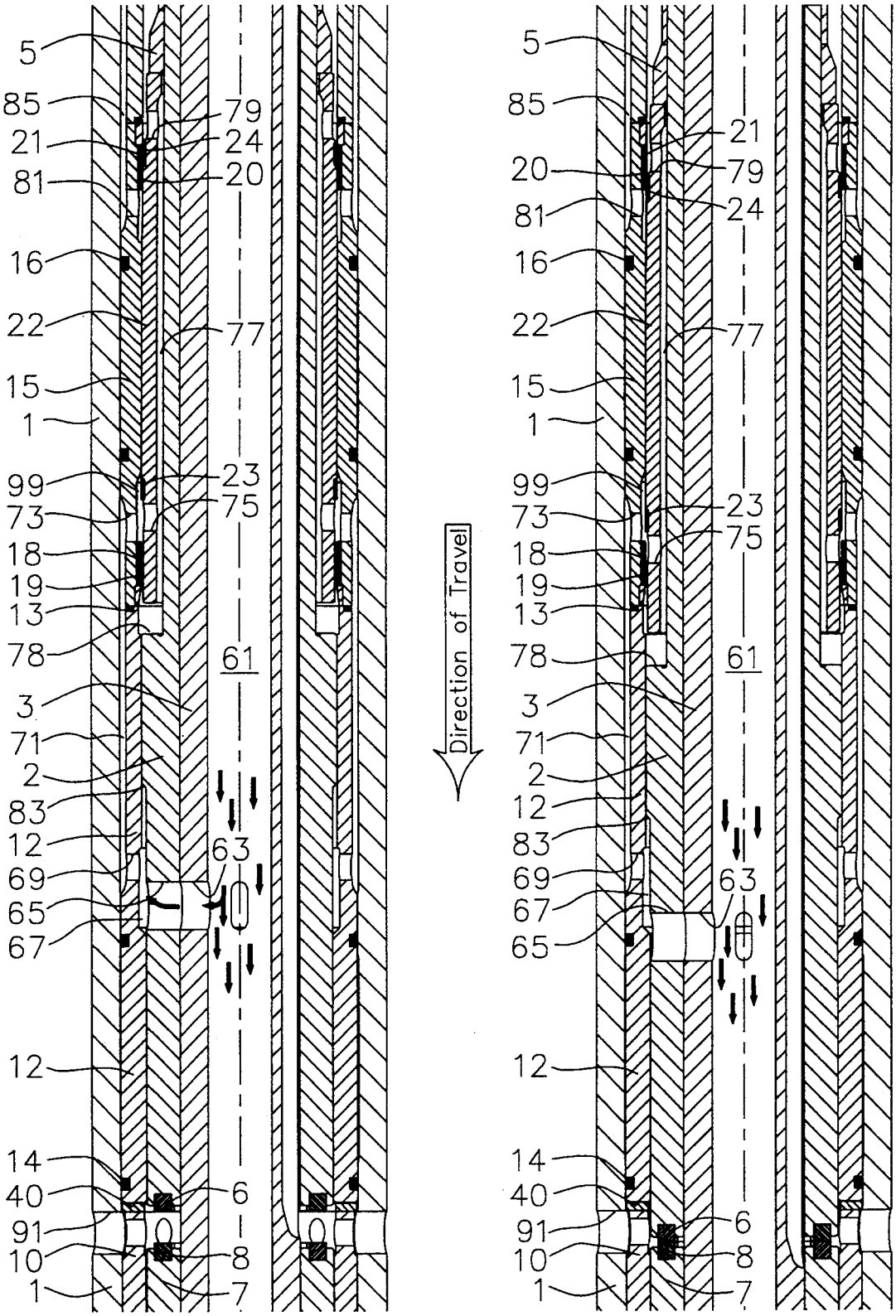

As best shown in FIGS. 8*a*–8*d*, the sliding valve is designed to slide between a position wherein the supply of high pressure mud does not pass beyond the chamber 99 into the downstroke chamber, and wherein mud is exhausted (see FIG. 8*a*), and a second position wherein high pressure mud is allowed into the downstroke chamber and not allowed to be exhausted (see FIG. 8*c*).

In more detail, FIG. 8*a* shows the piston 2 in the down position with its impact surfaces 6 contacting the impact surfaces 8 of the shank 7. The sliding valve 22 is also in its full down position. At this point in the cycle, the lower sealing ring 23 of the sliding valve 22 is in contact with the lower sealing ring 18 of the sleeve 15. As a result, high pressure mud is not allowed to pass from the chamber 71 into the port 75 or the downstroke chamber 77. Also at this point, the upper sealing ring 24 of the valve 22 is not in contact with the upper sealing ring 20 of the sleeve 15. Consequently, the mud in the downstroke chamber 77 is allowed to pass through the exhaust ports 79 and 81 into the exhaust passage 85. In this condition, the upward force acting on the piston by virtue of the surface 83 is sufficient to push the piston upward.

FIG. 8*b* shows the condition of the various parts after the piston has moved toward its up position. As can be seen, the valve 22 has been carried upward with the piston to a point where the lower sealing rings have just become disengaged. Consequently, high pressure mud is allowed through the ports 75 into the downstroke chamber 77. Also, at this switch point in the cycle, the upper valve sealing ring 24 is just coming into contact with the upper sleeve sealing ring 20. According to this most preferred embodiment, there are two short periods in the cycle where neither set of sealing rings is fully engaged. In other words, the upper set does not close until just after the lower set opens, and the lower set does not close until just after the upper set opens. This is preferred in order to reduce the pressure transients that would otherwise be set up in the mud with the rapid closing and opening of the valves.

In particular, the rapid switching of fluid flows between actuation chambers in a reciprocating tool necessitates the rapid stopping and starting of such flows. This may result in the generation of high pressure transients which may be damaging to the valve members or other critical tool components, or which may prevent the operation of the tool. During the operation of the hammer of the present invention, one such potentially harmful pressure situation arises at the switchpoint of the valve. On the upstroke of the hammer, fluid in the piston chamber is displaced by the hammer and exits through the exhaust porting. However, at the valve switchpoint, the exhaust chamber closes, preventing displaced fluid from exiting via that route. At the same time, the supply port opens, but only gradually. Hence for a short period of time, the fluid being displaced by the piston's upward movement encounters a high resistance to flow out of the chamber 77 through either port. This resistance to flow can cause high pressure transients. Pressure transients are also caused by the fact that the flow travelling through the chamber 77 becomes reversed suddenly as the exhaust port closes and the supply port opens.

It has been found that these transients may be dampened by simply increasing the leakiness of the valve at its switchpoint. As explained above, this is accomplished by constructing the valve such that it does not completely close off the exhaust pathways at exactly the same time it opens the supply pathway. Pressure in the piston chamber thus builds up more slowly, preventing the generation of high pressure transients.

In alternative embodiments where pressure transients will not be a serious problem, there are no such periods where both valves are open. Instead, one closes as the other opens and vice versa.

Once the upper sealing rings become engaged, the exhaust passage is shut off and the mud within the downstroke chamber becomes high pressure mud. One result is that the valve 22 is pushed upward. This is accomplished by virtue of the fact that the sleeve 15 has a reduced inside diameter and the valve 22 has a reduced outside diameter at the top. Consequently, the pressure of the mud pushes the valve upward until it engages the valve stop 5 on the piston as seen in FIG. 8*c*.

Also, as the pressure of the mud in the downstroke chamber builds, the upward momentum of the piston is overcome and the piston reverses direction and begins traveling downward toward the shank. Because the valve is engaged by the valve stop, the valve is carried downward with the piston.

FIG. 8*d* shows the piston in its down position. Just after impact, the downward momentum of the valve carries it down to where it engages the lower shoulder 78, or lower stop, of the piston as seen in FIG. 8*a*.

Four important features of this preferred embodiment make the depicted hammer particularly well suited for use down hole. First, the cycle just described is self-starting. Self-starting is implemented in the preferred embodiment by allowing supply pressure to constantly actuate the piston so that the piston will return to its most upward point if no other force is acting on it.

Because of this ever-present upward force, the hammer will always cycle if the mud pumps are supplying pressure to the bit and the overtravel mechanism and shut-off valve mechanisms described below are disengaged. In other words, the piston never experiences a balanced (zero net force) or stalled state during normal operation of the tool.

Second, the preferred embodiment includes the valving of only one actuating chamber. Since the return side of the piston is constantly under the influence of supply pressure, as explained above, the downstroke side of the piston is the only face of the piston to experience alternating high and low pressure. The switching of fluid pressures acting on the drive shoulder of the piston is accomplished by the motion of the shuttle valve described above. As the shuttle valve allows supply pressure to act on the downstroke side of the piston, the piston overcomes the constant return force and strokes downward; as the valve exhausts the downstroke side, the piston succumbs to the constant upward force and is driven upward.

Third, the method of valving is also designed to minimize the stalling potential of the tool. As the piston travels towards its most upward point in response to the force, the piston carries the shuttle valve with it causing the valve to change the pressure state of the piston (as explained above) and initiate the downstroke segment of the cycle. The valve is moved by the piston, which in turn initiates a change in piston motion. This positive motion feature is important to failsafe operation of the cycle, since it helps counter sticking of the valve which could occur due to fouling particles in the mud.

Fourth, the depicted hammer is designed so that it is operated solely by hydraulic pressure. Springs, which have shown a tendency toward fatigue failure in previous designs, need not be present. Instead, all forces acting on the piston are due to a pressure acting on an area within an actuating chamber.

Figure 4:
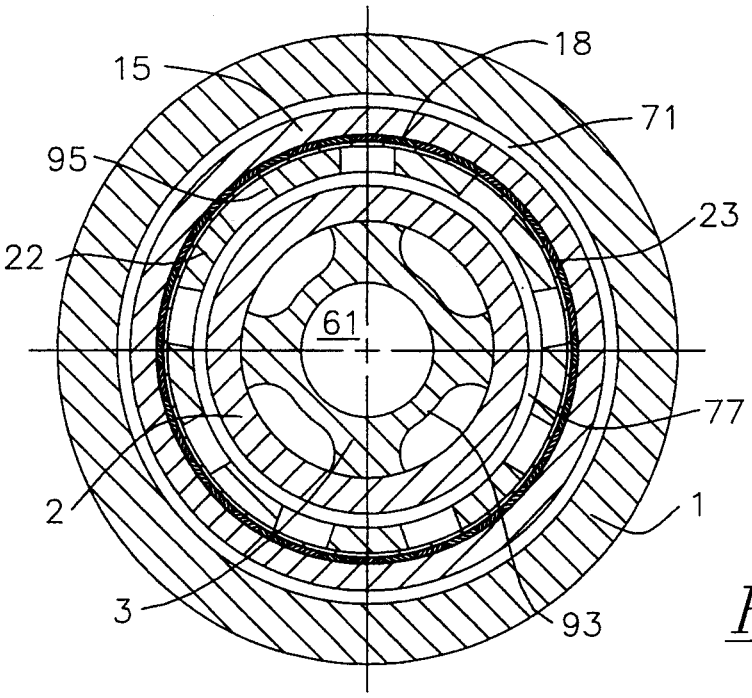
FIG. 4 is a cross-sectional view taken along line 4—4 of FIG. 2.

FIG. 4 is a cross section showing the engagement of the two sealing rings 18 and 23. Because high pressure mud passes over these surfaces at a high velocity, these surfaces are particularly subject to erosion. Consequently, it is preferred to provide a highly wear resistant material on the engaging surfaces of these sealing rings. Preferably, the material will be polycrystalline diamond (PCD). Because PCD is presently obtainable in relatively small pieces, it is preferred to use several appropriately shaped PCD tiles to construct each sealing ring.

Sliding valves are advantageous for use with particulate fluids (such as drilling mud) since they are self cleaning due to their wiping action. However, without special wear surfaces, which resist abrasion from particles trapped between sliding surfaces and erosion from high velocity fluids, such valves would have relatively short life expectancies. The preferred embodiment has overcome this problem by using tiles of a highly wear-resistant material, most preferably polycrystalline diamond tiles.

Figure 4A:
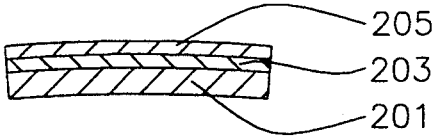
FIG. 4*a* is an enlarged cross-sectional view of a polycrystalline diamond wear surface used in the valve shown in FIG. 4.
Figure 5:
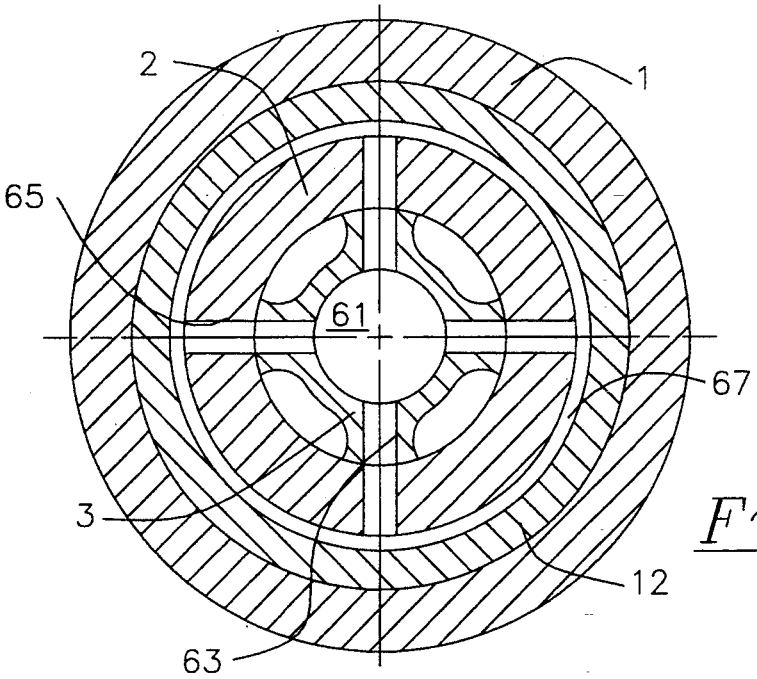
FIG. 5 is a is a cross-sectional view taken along line 5—5 of FIG. 2.

As shown in FIG. 4, there are preferably 40 PCD tiles in each of the sleeve sealing rings 20 and 18. Preferably, each of the valve sealing rings 23 and 24 has 39 PCD tiles. As shown in FIG. 4*a*, these tiles preferably include a backing of cemented carbide with a layer of polycrystalline diamond thereon.

Preferably, the PCD tiles are made according to the teachings of U.S. Pat. No. 4,604,106. The entire disclosure of this patent is incorporated herein by reference. This patent discloses the use of PCD made with a layer of composite PCD, i.e. PCD with pieces of precemented metal carbide dispersed therein. As shown in FIG. 4*a*, the tiles used in this embodiment will most preferably include an approximately 0.76 mm. thick surface layer 205 of virtually 100 weight percent diamond, a 0.76 mm. thick intermediate layer 203 having 40 weight percent diamond with 60 weight percent cobalt cemented tungsten carbide dispersed therein. The substrate 201 for this tile is about a 1.5 mm. thick cobalt cemented tungsten carbide base. Alternatively, the PCD tiles can be made without the transition layer of composite PCD material.

Each tile can be shaped by various conventional techniques. Preferably, the tile is formed in the ultra-high pressure press in a shape approximating its final shape. The shape can also be imparted by wire Electric Discharge Machine (EDM) cutting. Alternatively, the shape can be achieved by Electric Discharge Grinding (EDG).

Final finishing of the PCD tiles can also be accomplished by conventional techniques, such as lapping or high speed wear against the mating ring.

As explained above in connection with FIGS. 8*a–d*, the sliding valve 22 is carried upward toward—but not all the way to—its full up position by the lower stop of the piston. The valve is carried the rest of the way to the full up position by the action of the high pressure mud and its reduced outside diameter at the upper portion. Likewise, the sliding valve is carried downward toward—but not all the way to—its full down position by the upper stop of the piston. The valve is carried to its full down position by its momentum and gravity. This configuration is believed to provide the advantage that the valve is given a greater distance of travel than the piston. This is beneficial in a sliding valve where the effectiveness of the seal is proportional to the length of the seal.

Another important feature of this depicted preferred embodiment is the fact that the action of the sliding valve is independent of concentricity with the piston. In particular, the preferred design includes a gap between the sliding valve and the piston. In addition, the valve sleeve is independent of the sleeves in which the piston and throat slide. Also, sufficient clearance is provided between the sleeves and the housing. Finally, the sleeves are fitted within the housing with face seals between each of the sleeves 12, 15, and 25 to allow the sleeves to move radially relative to each other. As a result, the piston and sliding valves need not reciprocate about the same axis. Consequently, the hammer is better able to tolerate the bending it may encounter, particularly when used in directional drilling.

Yet another important feature of the depicted preferred embodiment is the fact that its design includes provisions for preventing the drilling mud outside of the housing (return mud) from entering into the tool. Even though the mud pumped from the drilling rig is quite abrasive, the mud returning from the hole bottom contains rock cuttings and is thus even more abrasive. As a result, it is desirable to prevent return mud from entering the hammer of the present invention in order to avoid increased abrasion of inner hammer components and to prevent clogging of the hydraulic circuits of the hammer. The prevention of return mud inflow, however, is difficult when the hammer device is actuated in both directions by hydraulic fluid, as is the case in the depicted embodiment. For at least one segment of the stroke, the piston must be acted upon by two different pressures. Hence, fluid of a pressure lower than supply pressure must be available which can bathe some of the surfaces of the piston. This low pressure fluid region must eventually communicate with the low pressure fluid in the annulus outside of the hammer tool; hence, a pathway to the exterior of the tool must exist.

At least a partial solution to this problem is provided by having all low pressure areas, or exhaust areas, interconnected within the body of the hammer. This is accomplished in the depicted embodiment by forming flow passageways between the upper and lower piston chambers as shown in FIGS. 2 and 8*a*–8*d*. Thus, as the piston oscillates and displaces fluid in these chambers, low pressure flow is shuttled between the two chambers via passageways through the piston. The flow in excess of that required to fill the displaced volumes travels within the interconnecting passageways and is brought to exit the tool at a common location.

The configuration which allows for this collection of exhaust flows is seen in FIGS. 2–6. In particular, four exhaust passages 93 are formed between grooves in the throat 3 and the inside surface of the piston 2. The exhaust passages 93 empty into the space between the piston and shank impact surfaces. The exhaust mud then passes out of the housing through the nine exhaust ports 92 in the shank sleeve 10 and then through the six exhaust ports 91.

Figure 11:
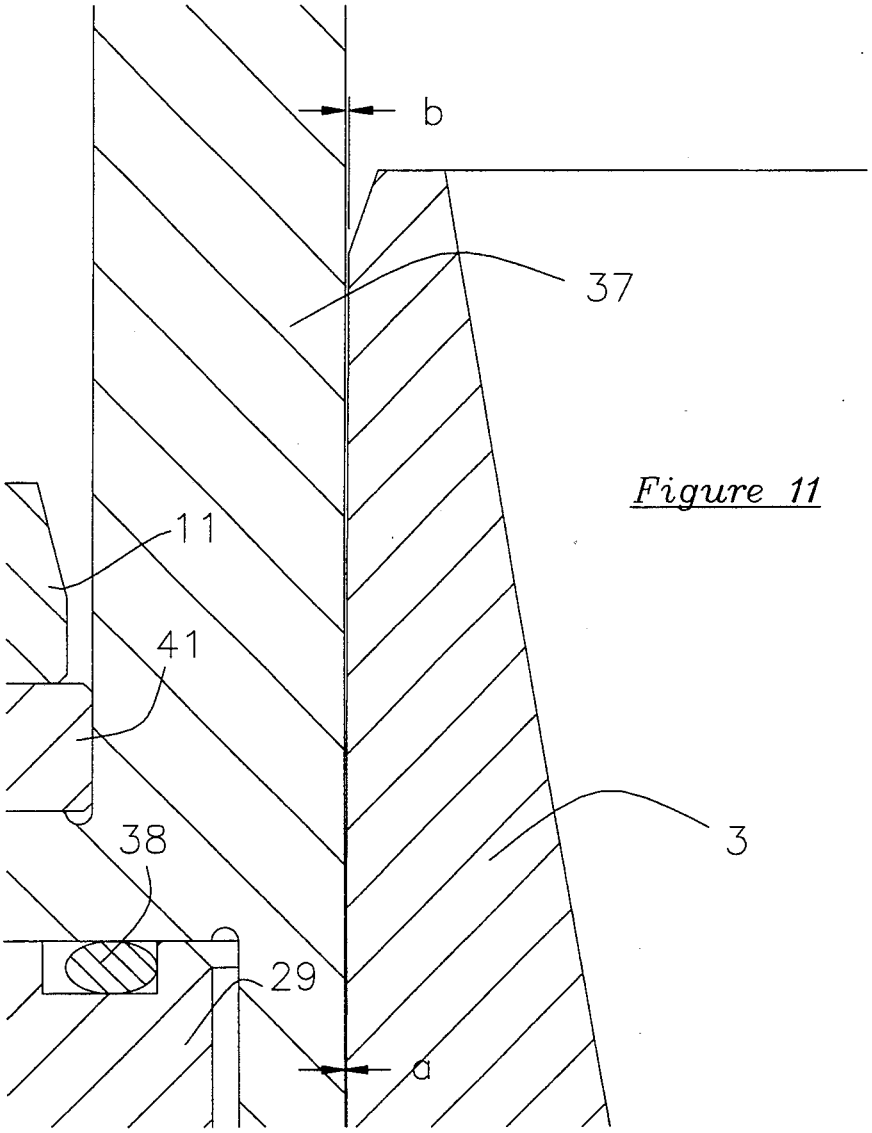
FIG. 11 is an enlarge cross-sectional view showing the controlled leakage of the throat bearing of the most preferred embodiment shown in FIG. 1.

At some points in the cycle of the hammer, however, the collection of the exhaust flow alone is insufficient to prevent inflow. Therefore, as shown in the enlarged view of FIG. 11, the depicted embodiment includes a second mechanism which reduces the inflow of return mud. This second mechanism relies upon tapered sleeve bearings. These bearings are designed such that, at critical positions in the hammer's cycle, additional leakage due to an increased cylindrical clearance in the bearing region due to the taper is provided. The volume of this leakage is such that any flow debt caused by the displacement of the piston is satisfied by leakage flow. Thus, flow is always out of the tool. Preferably, the leakage should be greater than 0 and less than about 15 percent of the total mud flow through the main passage; most preferably between about 1 and about 5 percent.

Still another advantage of the depicted embodiment is the fact that the stroke length for the piston can be easily adjusted. The stroke length of the piston has a large influence on the amount of energy delivered by the hammer to the bit. Since the level of blow energy required for optimal operation of the drilling tool will vary depending on the parameters of the formation being drilled, and since the blow energy will affect the life expectancy of the bit, as well as other components of the drill string, benefits in drilling speed and tool life accrue by allowing the adjustment of the stroke for different drilling situations.

In the depicted embodiment, the stroke length of the piston may be so adjusted by the insertion of simple cylindrical shims 40, 41 and 47 into the tool. Shim 40 is placed between the top of the shank sleeve 10 and the bottom of the supply sleeve 12. Shim 47 is placed between the uppermost shoulder of the housing 1 and the shut-off control housing 29. Shim 41 is placed between the lowermost portion of the backhead 11 and the throat bearing 37. In this arrangement, any increases or decreases in shim 40 should be matched in shim 47. Also, any increase in shim 40 should be accompanied by a like decrease in shim 41 and vice versa.

The thickness of these shims serves to move axially the column of sleeves above the shank sleeve, i.e. the supply sleeve 12, the valve sleeve 15, and the exhaust sleeve 25, which control the routing of high and low pressure mud. This movement causes a change in the switchpoint of the valve, i.e. the point at which the valve switches the pressure acting on the downstroke area from exhaust pressure to supply pressure. As a result of this change, the piston is allowed to travel farther upward before reaching the switchpoint. Consequently, the length of the stroke can be changed by inserting shims 40, 41, and 47 of various thicknesses in between the shank and supply sleeves.

Figure 6:
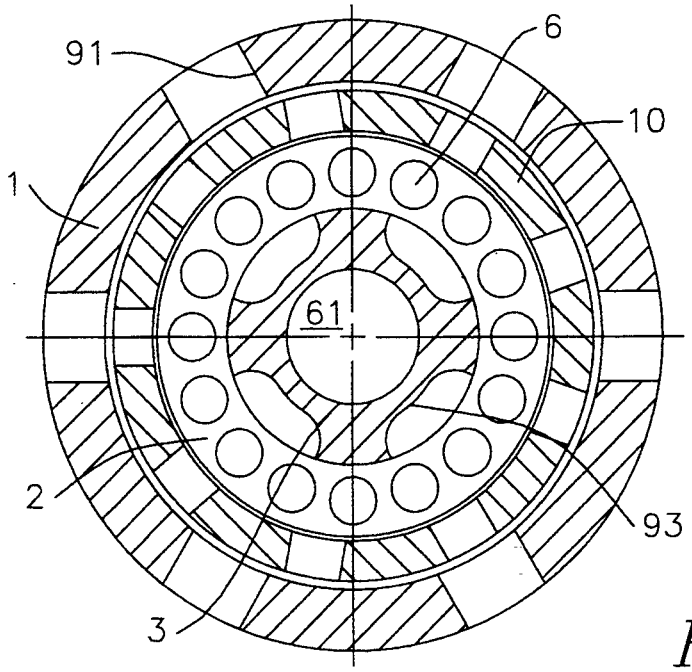
FIG. 6 is a is a cross-sectional view taken along line 6—6 of FIG. 2.

Referring to FIG. 6, which is a cross-sectional view looking up at the bottom of the piston, the impact surfaces of the piston are shown. As can be seen, the impact surfaces comprise a plurality of inserts or "buttons" 6. Preferably, these buttons will be made from a tough impact resistant and abrasion resistant material such as a cemented carbide, polycrystalline diamond, or hardened steel. Most preferably, the buttons are made from cobalt cemented tungsten carbide.

As shown, there are preferably 16 buttons in the bottom of the piston. Also, there are preferably 17 identical buttons 8 in the top of the shank 7. Because the piston is free to rotate within the housing, the number and placement of the impact buttons 6 and 8 are selected to provide sufficient overlap irrespective of the relative rotation between the piston and the shank.

The piston and shank of this preferred embodiment are bathed in drilling fluid. Therefore, when the piston approaches the shank prior to impact, drilling fluid must be displaced from the space between the two components. The velocity with which this fluid exits this space can be large, particularly as the surfaces become close together. This fluid velocity together with the abrasive particles in the drilling mud contributes to a significant amount of erosion of the impacting surfaces.

In order to reduce the erosion, the preferred embodiment uses the buttons described above. Preferably, these buttons are press fitted into the piston and shank, such that the surface of the buttons extend slightly above that of the substrate into which they are fitted. Since these buttons are raised above the surface of the less wear-resistant substrate material, they define the site of impact. In so doing, they cause the highest velocity flows to be generated above the substrate, which helps to prevent erosion of this softer material.

A number of buttons occupy the impact surface so that the stress wave produced by impact is distributed upon the surface. Even so, the magnitude of the stress wave produced by the impact is potentially large enough so as to fracture the wear resistant material, were it not supported by the underlying material. Consequently, the press fit between the buttons and the substrate is deemed to be important. By a proper selection of press fit, hard and brittle materials, such as polycrystalline diamond, which behave well in abrasive and erosive environments, but poorly under impact, can be used in impacting modes of operation.

Although cemented tungsten carbide is presently most preferred, because of the reasons just given, polycrystalline diamond may also be used. When PCD is used, the preferred composition is that described in U.S. Pat. No. 4,604,106, the entire disclosure of which is incorporated herein by reference. This particular type of polycrystalline diamond is a compact having several transition layers comprising a composite of precemented carbide and PCD. These transition layers increase the impact resistance of the PCD.

Figure 7:
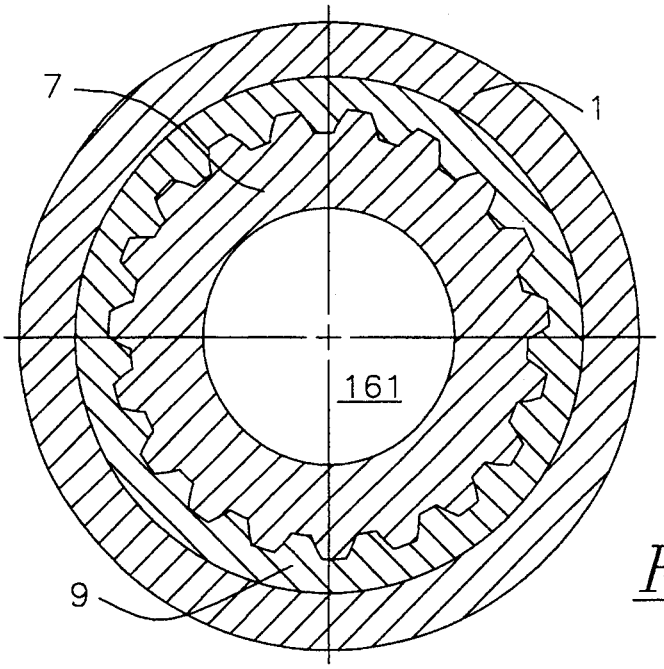
FIG. 7 is a cross-sectional view taken along line 7—7 of FIG. 2.

As seen in FIGS. 2 and 7, the shank 7 is attached to the housing 103 in such a manner that the shank may move a limited distance axially away from its normal impact position, yet is still constrained to rotate with the rest of the drillstring. This is accomplished by use of splines 211 on the shank 7 which engage splines 213 on the bit retainer sub 9. As a result, rotation of the backhead 11, the housing 1, and the drill sub 9, imparts rotation to the shank 7. The upward movement of the shank is limited by the shoulder 217 of the shank contacting the bottom surface 215 of the bit retainer sub. The downward movement of the shank is limited by the top splines 221 engaging the split ring 39. The split ring 39 is inserted between the top of the bit retainer sub 9 and the shoulder 223 of the middle section of the housing 1 after the shank has been inserted into the sub 9. Preferably, the shank sleeve 10 and sub 9 will be made from a berryilium copper alloy to prevent galling between the shank and these parts.

Figure 9A:
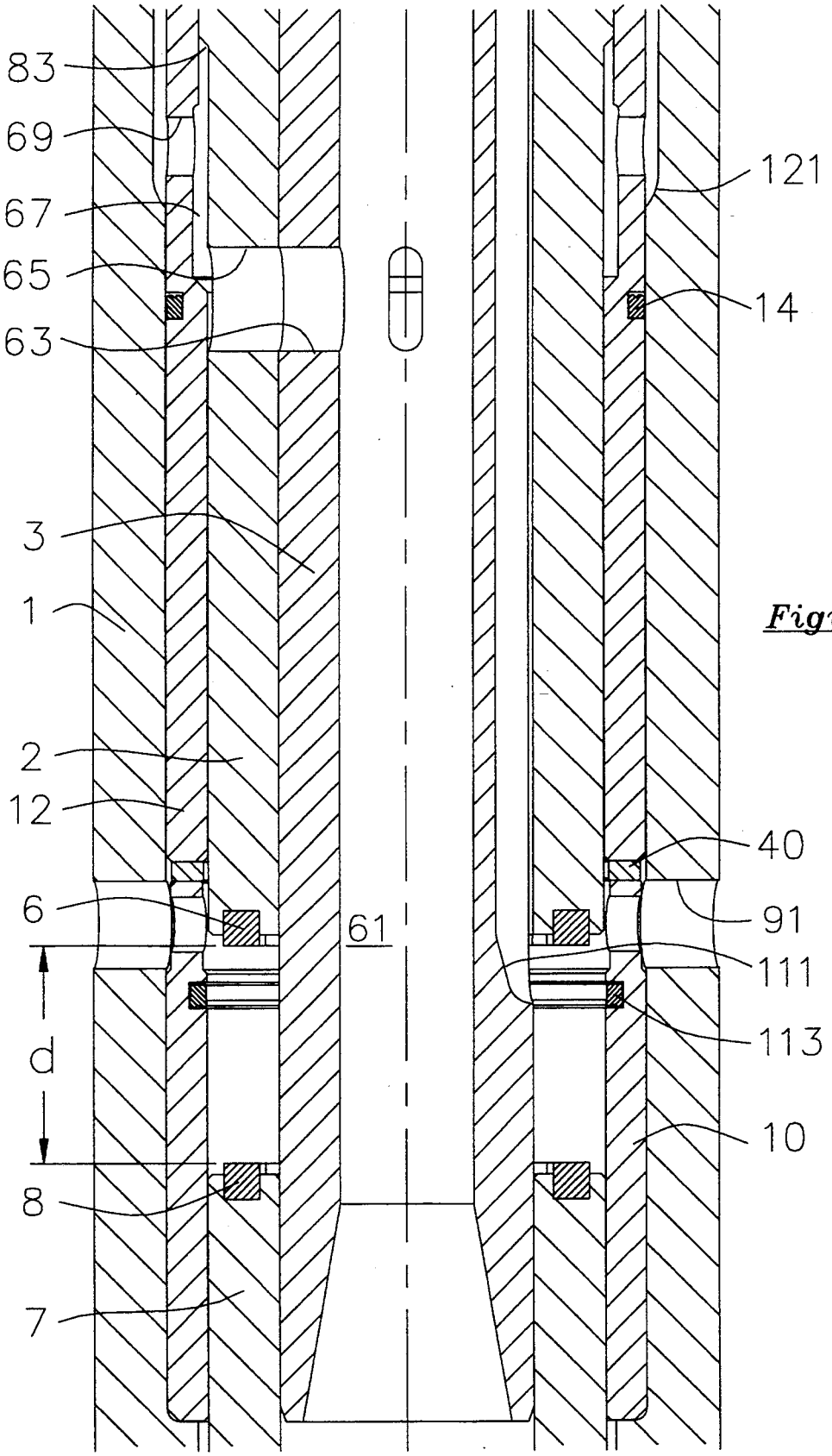
FIGS. 9*a* and 9*b* are enlarged partial cross-sectional views illustrating the operation of the overtravel mechanism of the most preferred embodiment shown in FIG. 1.
Figure 9B:
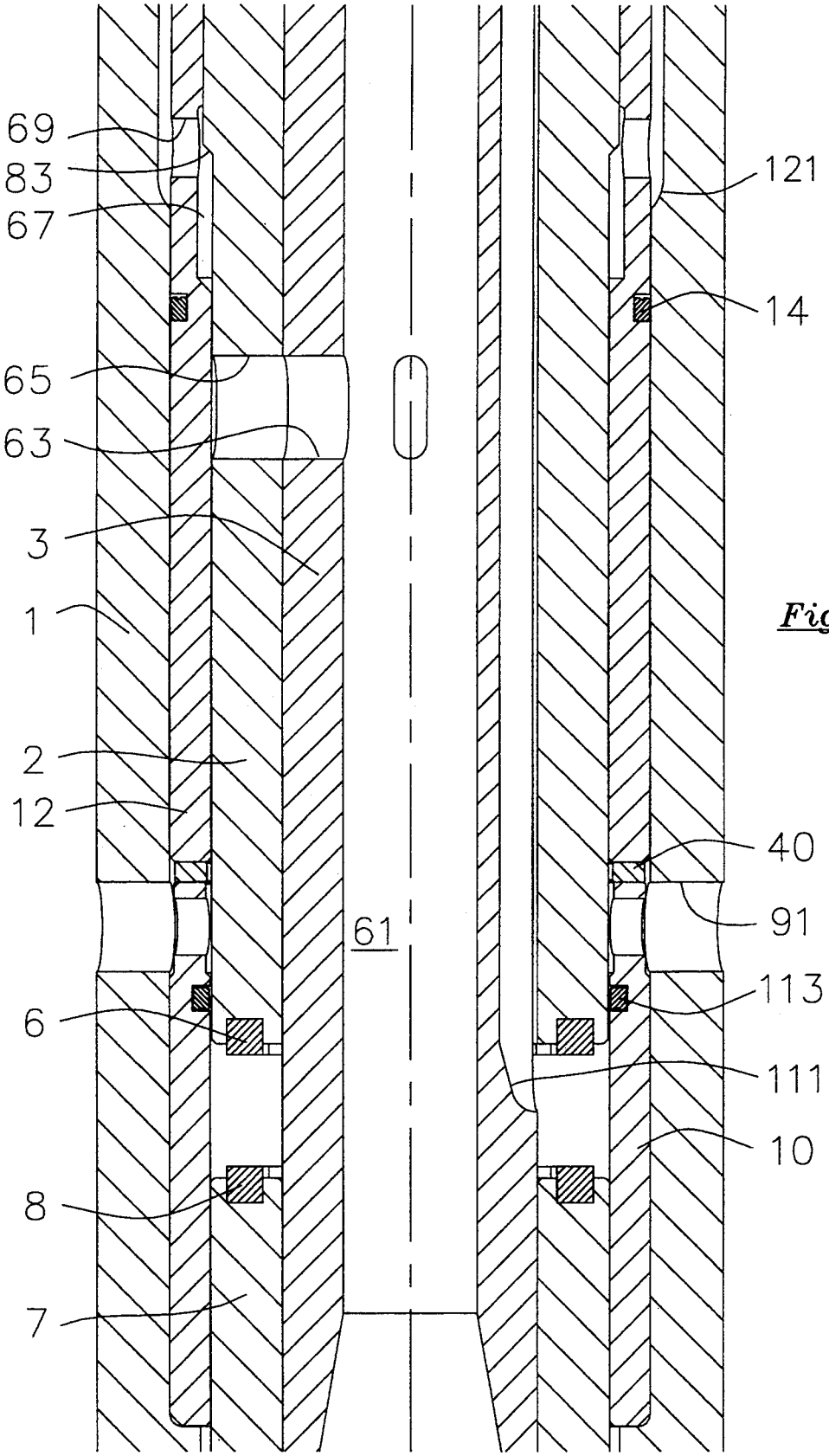

FIGS. 9*a* and 9*b* illustrate an overtravel mode for the preferred embodiment. In particular, FIG. 9*a* shows the condition when the drill string is being lifted from the hole. As this happens, the shank 8 is allowed to fall away from its normal full up position, i.e. when the weight of the drill string is resting on the drill bit and the shoulder 217 of the shank contacts the bottom 215 of the sub (See FIG. 2). As the drill string is lifted, the shank is allowed to move downward, relative to the housing, until the upper spline 221 contacts the split ring 39.

As seen in FIG. 9*b*, when the shank 7 falls away, the piston is also allowed to move downward past its normal down position. When this happens, the exhaust port 111 of the throat is brought below the exhaust port 91 in the housing. When a seal, such as the elastomeric seal 113 is placed within the shank bearing sleeve 10, the mud in the exhaust passages is prevented from passing out of the housing through the annulus created between the piston 2 and the shank sleeve 10. As a result, the pressure within the exhaust passage becomes equal to the pressure within the supply passage and the piston stops reciprocating. This is particularly advantageous in that it provides an inactive mode for the piston while the drill string is being lifted from the hole.

An alternative overtravel mode is provided by removing the seal 113. When the seal is absent, the mud in the exhaust passages is allowed to exit through the annulus created between the piston 2 and the shank sleeve 10 out through the exhaust ports 91. As a result, the piston continues to reciprocate as the downstroke chamber is alternatingly pressurized and exhausted. However, because the shank has moved out of its normal position, the impact surfaces of the piston do not strike the shank. Instead, the piston begins to move upward at a point between its normal down position and the overtravel position of the shank. This overtravel down position for the piston is defined by the pressure of the drilling mud, the initial stroke length of the piston, together with the fact that fluid dampers are created as the upper ports 65 become closed. In general, the piston will reciprocate in an overtravel cycle which is longer and slower than its normal hammering cycle.

It is a significant advantage that the drill operator can select either of these two overtravel modes by simply installing or removing the seal 113. This design feature provides the depicted hammer with two modes of operation (or lack of operation) for the special circumstance when the drill string is pulled up off of the bit. Under this circumstance, normal hammering is not tolerable, since the bit is not assured of intimate contact with the hole bottom. Without this intimate contact, the impact stress wave intended for transmission to the rock would fail to be substantially transmitted to the rock and would reflect at the free end of the bit, perhaps damaging the bit or the drillstring.

In some circumstances, the effect of down-hole percussion devices on drilling rate is too great. This is particularly noted by those attempting directional drilling while a hammer is operating. In these cases, hammers sometimes tend to straighten the hole, rather than allow the desired deviation. For this reason, it is useful to be able to deactivate the hammer during such operations. In other circumstances, such as during the retrieval of the drill string, it is likewise advantageous to deactivate the hammer so that the mechanical components may enjoy longer life.

In view of these circumstances, the preferred embodiment of the present invention includes a valve in its design which has the capability of causing reciprocation of the hammer element to cease while still allowing for operation of the drill bit.

To allow maximal speed and ease of control, the mud pressure was selected as the controlled variable, since mud pressure may be quickly and easily changed at the top of the hole.

Figure 10A:
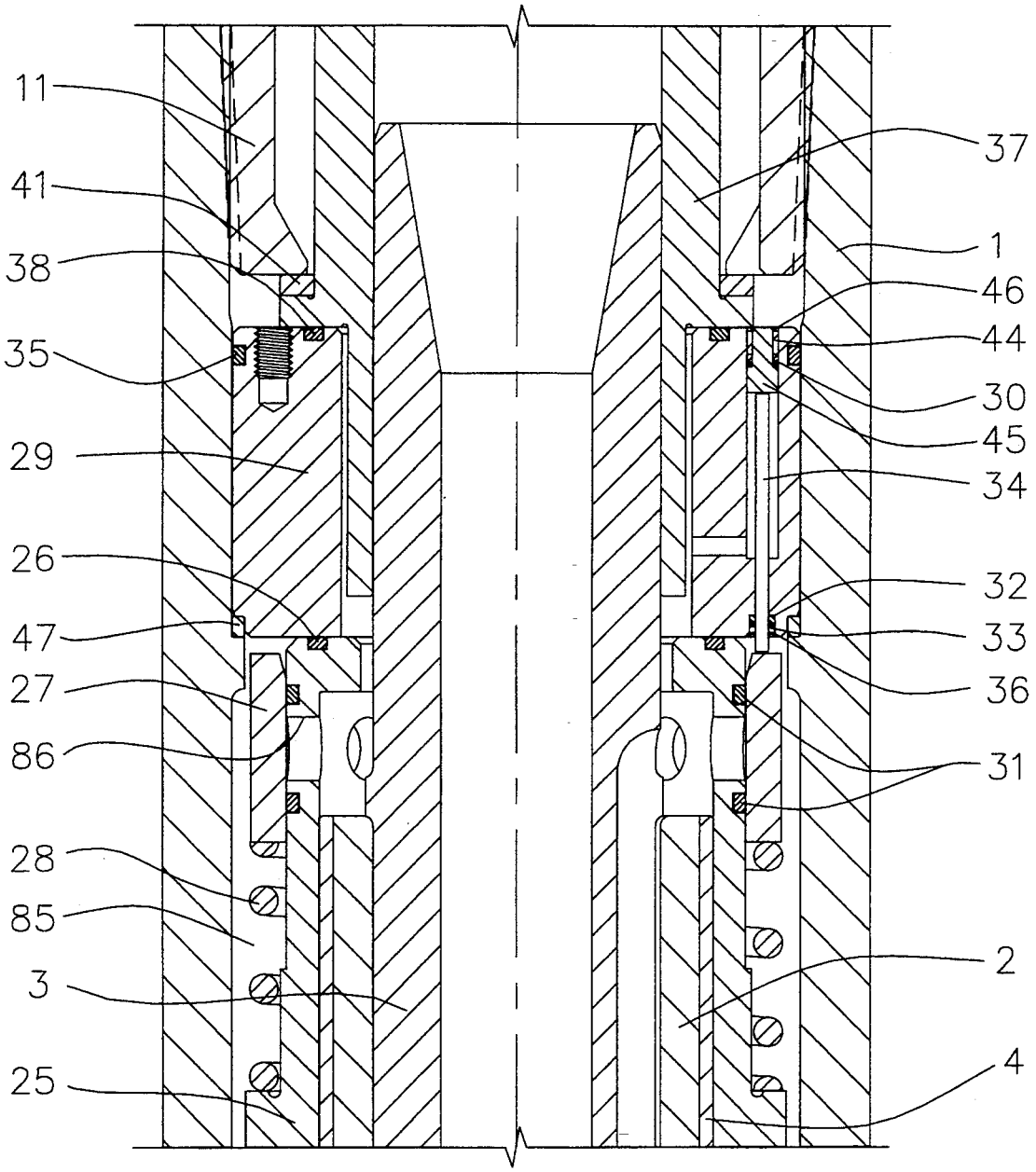
FIGS. 10*a*–10*d* are a set of enlarged partial cross-sectional views illustrating the operation of the shut-off valve of the most preferred embodiment shown in FIG. 1.
Figure 10B:
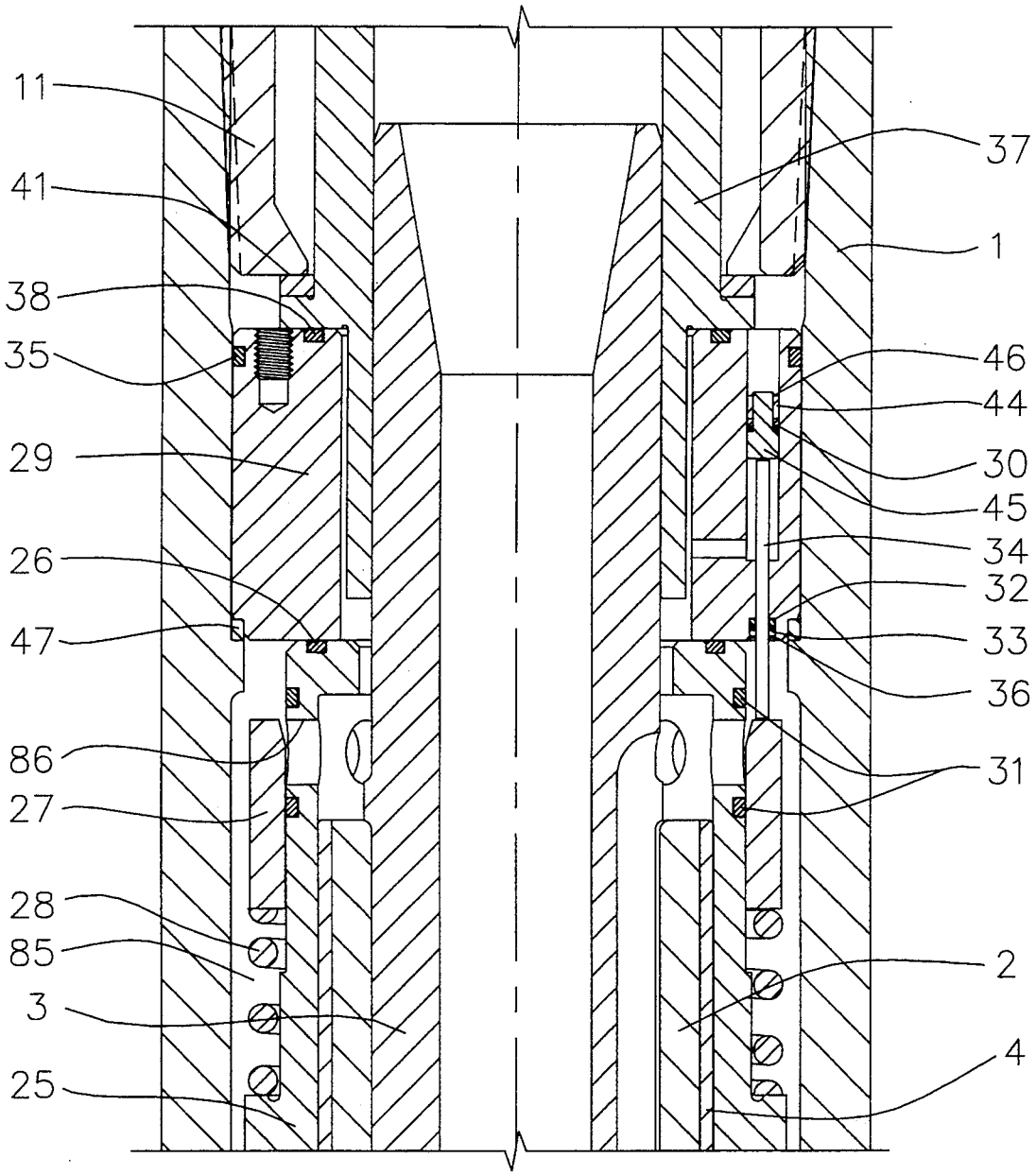
Figure 10C:
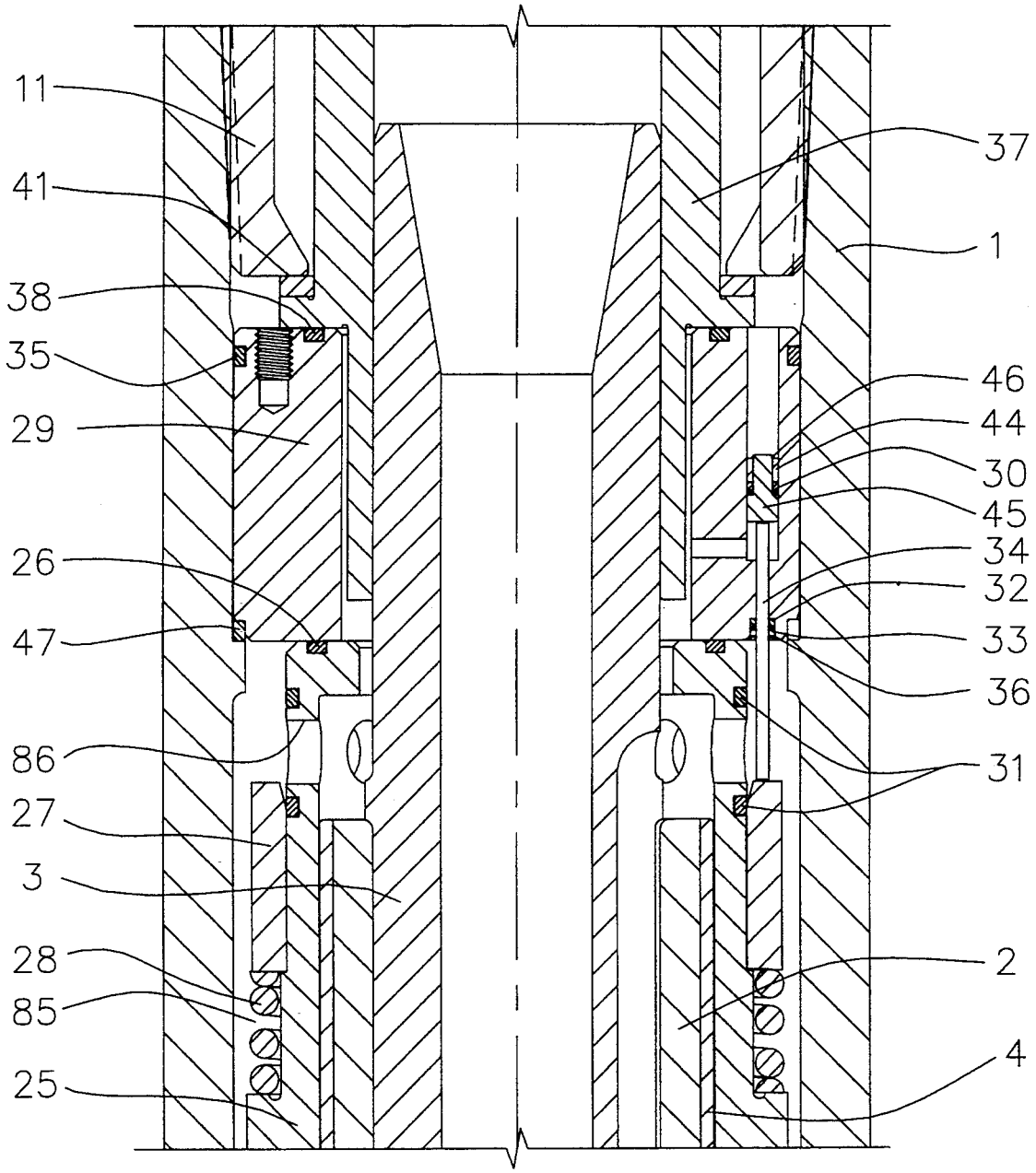
Figure 10D:
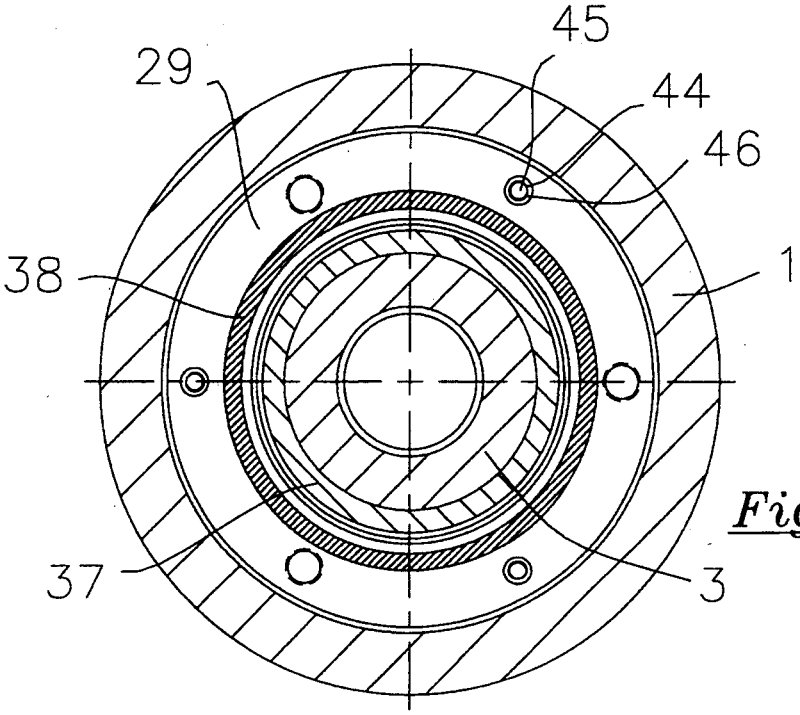

Referring to FIG. 10*a*, the operation of the shut-off valve in the depicted embodiment is described as follows. A spring 28 applies a given preload force, $F_s$, to a simple sleeve valve 27. This force urges the valve towards its closed position. Consequently, the valve is of a "normally closed" configuration. In this closed position, the seals 31 engage the inside diameter of the valve 27, thus preventing flow from exhausting from the piston downstroke chamber 77 through passageway 85 and ports 86. By so doing, the valve causes the pressure in the downstroke chamber of the piston to increase from exhaust pressure to a pressure essentially equal to the supply pressure. Hence, the tendency of the piston to return to the top of its travel is overcome and the piston remains at rest.

A passageway 231 [See FIG. 2] is provided at the top of the hammer which allows high pressure mud to fill the chamber 233. As seen, this passageway requires that mud flow around several turns before it reaches the chamber 233. This feature ensures that the mud finally reaching chamber 233 is relatively free from large particles, since these large particles are less likely to accomplish the turns in the passageway. In the most preferred design, the actual volume flowing into and out of the chamber 233 once it has been initially filled will be less than the volume of the annulus between sleeves 37 and 51. Thus, no new fluid need enter chamber 233. This allows the fluid to remain "clean" even if the supply mud becomes contaminated.

Communicating with the chamber 233 is the upper surface of a number of cylindrical pistons 45, each of which is housed within a cylindrical bore 235. The lower surface of each piston is bathed in low pressure fluid, which fills the bore 235 from the exhaust chamber 88 via annulus 237 and ports 239. This pressure imbalance causes a net downward force $F_p$, to be exerted on the piston, which is proportional to the supply pressure.

Within each bore 235 is a cylindrical pin 34, which has a flattened end which seats upon the lower surface of the piston 45 and another end which seats upon the upper surface of the sleeve valve 27. Any force exerted on the piston 45 is thereby transferred to valve 27 via pin 34. It is important to note that the pin 34 also experiences a net pressure force when the valve 27 is closed, since in this case, the bottom of the pin is bathed in supply pressure mud and the top is bathed in low pressure mud. This force counteracts in part the force generated by the piston 45, producing a net force acting $F'_p$ on the valve 27. This force is somewhat less than the force $F_p$. However, when the valve 27 is opened, the exhaust pressure on both ends of the pin becomes the same, and no force is supplied by the pin to counteract the piston force. Hence, the net force acting on the top of the valve increases to $F_p$.

As the supply pressure acting on the pistons 45 increases, $F_p'$ increases until it slightly exceeds $F_s$. At this point, the pin force prevails against the spring force and the pin begins to move the valve towards its open position. As the valve moves off of its upper seal 31, the pressure in the downstroke chamber is allowed to exhaust through the exhaust passageway, causing the pressure in the downstroke chamber to decrease. This causes the net force on the valve to increase to $F_p$, as explained above. The increased force $F_p$, together with the loss of the frictional force between valve 27 and the upper sealing ring 31 is sufficient to cause the valve to finish its travel and remain wide open. With the valve wide open, the normal operating pressure scenario is established within the tool, and normal cycling of the hammer occurs.

When the tool needs to be turned off, the drill operator simply reduces the supply pressure (which acts on the pins) until the spring force $F_s$ overcomes the pin force $F_p$ and pushes the valve 27 shut.

A few comments about this shut-off valve operation are appropriate. First, it should be noted that by changing the cross section of the pistons, the pressure which is required to initially overcome the spring force $F_s$ likewise changes. This provides a method by which the minimum operating pressure of the hammer may be changed. This is a useful feature, since it gives the drill operator a great deal of flexibility as to the pressures which may be used for conventional versus hammer drilling.

It is also worth noting that the force $F_s$, which also controls the pressure at which the valve is forced open, may be changed by simply changing the spring or the degree of its precompression. However, the preferred embodiment of Novatek's tool provides for changing the forces acting on the valve by changing the pistons as described above. Hence, the spring, which lies relatively deep within the tool, does not need to be retrieved and replaced.

Another useful feature of this valving scheme derives from the valve seal 31. Common springs are not snap-acting; i.e., the force required to start to move a spring from its initial compression does not also complete the travel of the spring and hold in its final compression. Thus, a range of forces must be experienced by the spring during its total travel. If a piston of constant cross section were acted upon by pressurized fluid, a wide range of pressures would be required to move spring and valve from the initial compression to its final. At intermediate pressures, the valve would reside at a positions where it would not be totally effective and low efficiency reciprocation of the piston would occur. However, by using valve seals, the net cross section of the piston exposed to high pressure can be changed at the valve switchpoint. Thus two forces are created by the same pressure (see the above discussion of $F_p$ and $F_p'$), and the entire displacement of the valve may be effected at one pressure. This feature makes the valve fast acting and at the same time increases the range over which the tool may be operated.

It should be noted that although much of the discussion has assumed that the depicted mud hammer would be used to drill a vertical hole, it is noted that the mud hammer of the invention will also find particular application when drilling nonvertical holes. It should also be noted that, although the term "mud" has been used to describe the drilling fluid which passes through and actuates the hammer of the invention, the term is intended to be interpreted generically to cover conventional as well as nonconventional drilling fluids, such as oil-based drilling fluids, or water. In addition, it should be noted that although the preferred embodiment shows the main passageway located through the center of the hammer, other embodiments are contemplated which would route the main flow of mud around the center of the hammer. Further, it should be noted that, although the preferred embodiment includes a shank which is allowed to move axially within the housing; other embodiments do not include such a shank. In these other embodiments, the piston is attached directly to the bit and the bit thereby reciprocates with the piston. Certainly, these and all other modifications which are within the ordinary skill in the art to make are considered to lie within the scope of the invention as defined by the appended claims.

I claim:

1. A down-hole mud actuated hammer for use in a drill string, said mud hammer comprising:

a housing including an upper end with means for connecting to the drill string, and a lower end;

a throat within the housing which includes a main flow passage to allow high pressure mud to pass from the upper end of the housing to the lower end thereof; and a piston adapted to move axially within the housing to thereby reciprocate between an up position and a down position;

wherein the piston is moved between the up position and the down position by a minor portion of the high pressure mud which portion passes from the main flow passage into at least one actuating chamber, and which minor portion is exhausted to a low pressure region out of the housing without being returned to the main flow passage.

2. The down-hole mud actuated hammer of claim 1 wherein the minor portion of mud is between about 5 and about 35 percent of the total flow through the main passage.

3. The down-hole mud actuated hammer of claim 1 wherein the minor portion of mud is between about 10 and about 20 percent of the total flow through the main passage.

4. The down-hole mud actuated hammer of claim 1 further comprising:

a shank slidably fitted into the lower end of the housing, the shank having a lower end with means for connecting to the drill string, and having an upper end with at least one impact surface; and wherein the piston includes a lower end having at least one impact surface adapted to strike the impact surface of the shank when the piston is in the down position.

5. The down-hole mud actuated hammer of claim 4 wherein the shank and piston each have a plurality of impact surfaces, and wherein the impact surfaces are provided in the form of inserts fitted into the shank and piston.

6. The down-hole mud actuated hammer of claim 5 wherein the inserts each comprise an impact layer of a material selected from the group consisting of cemented carbide, polycrystalline diamond, and polycrystalline cubic boron nitride.

7. The down-hole mud actuated hammer of claim 1 wherein the minor portion of mud is exhausted through an exhaust passage and wherein a second minor portion of the drilling mud is also exhausted through the exhaust passage to thereby insure a positive flow out of the exhaust passage during operation of the hammer.

8. A down-hole mud actuated hammer for use in a drill string, said mud hammer comprising:

a housing including an upper end with means for connecting to the drill string, and a lower end;

a throat within the housing which includes a main flow passage to allow high pressure drilling mud to pass from the upper end of the housing to the lower end thereof;

a shank slidably fitting within the lower end of the housing, the shank including a lower end with means for connecting to a drill string or drill bit, and having an upper end with impact surfaces;

a piston adapted to move axially within the housing to thereby reciprocate between an up position and a down position, the piston including a lower end having impact surfaces adapted to strike the impact surfaces of the shank when the piston is in the down position;

an upstroke chamber adapted so that when high pressure mud flows into the upstroke chamber, the high pressure mud contacts an upward actuating surface of the piston and thereby exerts an upward force on the piston;

a down stroke chamber adapted so that when high pressure mud flows into the downstroke chamber, the high pressure mud contacts a downward actuating surface of the piston to thereby push the piston downward to the down position wherein the impact surfaces of the piston strike the impact surfaces of the shank; and a sliding valve adapted to slide between a first position wherein high pressure mud from the main flow passage is allowed to flow into the downstroke chamber, and a second position wherein the mud is exhausted from the downstroke chamber through an exhaust passage to a low pressure region out of the housing without being returned to the main flow passage.

9. The down-hole mud actuated hammer of claim 8 wherein the portion of mud taken from the main passage to actuate the piston is between about 5 and about 35 percent of the total flow through the main passage.

10. The down-hole mud actuated hammer of claim 8 wherein the portion of mud taken from the main passage to actuate the piston is between about 10 and about 20 percent of the total flow through the main passage.

11. The down-hole mud actuated hammer of claim 8 wherein the impact surfaces of the shank and the impact surfaces of the piston are provided in the form of inserts fitted into the shank and piston.

12. The down-hole mud actuated hammer of claim 11 wherein the inserts each comprise an impact layer of a material selected from the group consisting of cemented carbide, polycrystalline diamond, and polycrystalline cubic boron nitride.

13. The down-hole mud actuated hammer of claim 8 wherein a second minor portion of the drilling mud is also exhausted through the exhaust passage to thereby insure a positive flow out of the exhaust passage during operation of the hammer.

14. The down-hole mud actuated hammer of claim 8 wherein the sliding valve comprises a sealing ring with a polycrystalline diamond wear surface.

15. The down-hole mud actuated hammer of claim 14 further comprising a valve sleeve which comprises a sealing ring with a polycrystalline diamond wear surface adapted to mate with the polycrystalline diamond wear surface of the sealing ring of the sliding valve.

16. The down-hole mud actuated hammer of claim 8 wherein the throat and piston are formed in one piece.

17. The down-hole mud actuated hammer of claim 8 wherein the piston is disposed concentrically around the throat and is fixedly attached thereto so that the throat moves reciprocally with the piston.

18. The down-hole mud actuated hammer of claim 8 wherein the throat is fixedly attached to the housing.

19. The down-hole mud actuated hammer of claim 6 wherein the piston includes a lower stop which is adapted to contact the sliding valve as the piston travels to the up position to thereby move the sliding valve upward.

20. The down-hole mud actuated mud hammer of claim 19 wherein the piston includes an upper stop which is adapted to contact the sliding valve as the piston travels to the down position to thereby move the sliding valve downward.

21. The down-hole mud actuated hammer of claim 8 further comprising pressure activated shut-off means comprising:

a shut-off valve adapted to slide between a first position which closes the exhaust passage to thereby prevent exhausting of mud in the downstroke chamber, and a second position which opens the exhaust passage;

biasing means for biasing the valve toward the first position with a predetermined biasing force;

a shut-off valve actuating chamber wherein mud from the drill string contacts at least one actuating surface to thereby create a force opposing the predetermined biasing force, said opposing force being sufficient to push said shut-off valve into said second position when the mud in the drill string possesses a predetermined pressure.

22. The down-hole mud actuated hammer of claim 21 wherein the biasing means is easily replaceable to thereby allow adjustment of the predetermined pressure at which the shut-off means is activated.

23. The down-hole mud actuated hammer of claim 21 wherein the biasing means is a precompressed spring and wherein adjustment of the predetermined pressure at which the shut-off means is activated can be made by changing the degree of precompression on the spring.

24. The down-hole mud actuated hammer of claim 21 further comprising a plurality of shut-off valve actuating pistons each having a first surface communicating with the shut-off valve actuating chamber, and a second surface at the other end communicating with a chamber supplied with high pressure mud when the shut-off valve is closed and which chamber is exhausted when the shut-off valve is open.

25. The down-hole mud actuated mud hammer of claim 24 wherein the shut-off valve actuating pistons further comprise a pin which contacts the shut-off valve.

26. The down-hole mud actuated mud hammer of claim 24 further comprising a plurality of filtering means for filtering the mud between the drill string and the shut-off valve actuating chamber.

27. The down-hole mud actuated mud hammer of claim 26 wherein the filtering means comprises a tortuous passageway through which the mud must pass to reach the shut-off valve actuating chamber.

28. A down-hole mud actuated hammer for use in a drill string, said mud hammer comprising:

a housing including an upper end with means for connecting to the drill string, and a lower end;

a throat within the housing which includes a main flow passage to allow high pressure drilling mud to pass therethrough;

a shank slidably fitting within the lower end of the housing, the shank including a lower end with means for connecting to a drill string, and having an upper end with a plurality of impact surfaces;

a piston disposed concentrically around the throat and adapted to move axially within the housing to thereby reciprocate between an up position and a down position, the piston including a lower end having a plurality of impact surfaces adapted to strike the impact surfaces of the shank when the piston is in the down position;

an upstroke chamber adapted so that when a minor portion of the high pressure mud flows through a high pressure passage into the upstroke chamber, the high pressure mud contacts an upward actuating surface of the piston and thereby exerts an upward force on the piston;

a downstroke chamber adapted so that when high pressure mud flows into the downstroke chamber, the high pressure mud contacts a downward actuating surface of the piston to thereby push the piston downward to the down position wherein the impact surfaces of the piston strike the impact surfaces of the shank;

a sliding valve disposed concentrically around the piston with a gap therebetween to allow mud to flow between the upstroke chamber and the downstroke chamber, the sliding valve further comprising at least one high pressure supply port and at least one mud exhaust port; and a valve sleeve comprising high pressure mud supply passage and a mud exhaust passage;

wherein the sliding valve is adapted to slide between a first position wherein high pressure mud is allowed to flow from the high pressure supply passage through the high pressure mud supply port into the downstroke chamber and wherein mud is not allowed to be exhausted from the downstroke chamber; and a second position wherein mud is allowed to flow from the downstroke chamber through the mud exhaust port, through the exhaust chamber to a low pressure region out of the housing without being returned to the main flow passage.

29. The down-hole mud actuated hammer of claim 28 wherein the portion of mud taken from the main passage to actuate the piston is between about 5 and about 35 percent of the total flow through the main passage.

30. The down-hole mud actuated hammer of claim 28 wherein the portion of mud taken from the main passage to actuate the piston is between about 10 and about 20 percent of the total flow through the main passage.

31. The down-hole mud actuated hammer of claim 28 wherein the impact surfaces of the shank and the impact surfaces of the piston are provided in the form of inserts fitted into the shank and piston.

32. The down-hole mud actuated hammer of claim 31 wherein the inserts each comprise an impact layer of a material selected from the group consisting of cemented carbide, polycrystalline diamond, and polycrystalline cubic boron nitride.

33. The down-hole mud actuated hammer of claim 28 wherein a second minor portion of the drilling mud is also exhausted through the exhaust passage to thereby insure a positive flow out of the exhaust passage during operation of the hammer.

34. The down-hole mud actuated hammer of claim 33 wherein the second minor portion of the drilling mud is greater than 0 and less than about 15 percent of the total flow through the main passage.

35. The down-hole mud actuated hammer of claim 28 wherein the sliding valve comprises an upper and a lower sealing ring each with a polycrystalline diamond wear surface, and wherein the valve sleeve comprises an upper and a lower sealing ring each with a polycrystalline diamond wear surface.

36. The down-hole mud actuated hammer of claim 28 wherein the throat and piston are formed in one piece.

37. The down-hole mud actuated hammer of claim 28 wherein the piston is fixedly attached to the throat so that the throat moves reciprocally with the piston.

38. The down-hole mud actuated hammer of claim 28 wherein the throat is fixedly attached to the housing.

39. The down-hole mud actuated hammer of claim 24 wherein the piston includes a lower stop which is adapted to contact the sliding valve as the piston travels to the up position to thereby move the sliding valve from the second position toward the first position.

40. The down-hole mud actuated hammer of claim 39 wherein the sliding valve is moved by the lower stop to a point intermediate between the second and the first position, and wherein the sliding valve is moved the remainder of the distance to the first position by means of high pressure mud contacting an actuating surface of the sliding valve.

41. The down-hole mud actuated hammer of claim 39 wherein an upper portion of the valve sleeve has an inside diameter, which is smaller than the inside diameter of a lower portion of the valve sleeve, and wherein an upper portion of the sliding valve has an outside diameter smaller than the outside diameter of a lower portion of the sliding valve, whereby when high pressure mud is allowed in the annulus between the sliding valve and the piston, the sliding valve is pushed upward.

42. The down-hole mud actuated hammer of claim 39 wherein the piston includes an upper stop which is adapted to contact the sliding valve as the piston travels to the down position to thereby move the sliding valve from the first position toward the second position.

43. The down-hole mud actuated hammer of claim 42 wherein the sliding valve is moved by the upper stop to a point intermediate between the first and the second position, and wherein the sliding valve is moved the remainder of the distance to the second position by virtue of gravity and momentum.

44. The down-hole mud actuated hammer of claim 28 wherein the piston includes an upper stop which is adapted to contact the sliding valve as the piston travels to the down position to thereby move the sliding valve from the first position toward the second position.

45. The down-hole mud actuated hammer of claim 44 wherein the sliding valve is moved by the upper stop to a point intermediate between the first and the second position, and wherein the sliding valve is moved the remainder of the distance to the second position by virtue of gravity and momentum.

46. The down-hole mud actuated hammer of claim 28 wherein an upper portion of the valve sleeve has an inside diameter, which is smaller than the inside diameter of a lower portion of the valve sleeve, and wherein an upper portion of the sliding valve has an outside diameter smaller than the outside diameter of a lower portion of the sliding valve, whereby when high pressure mud is allowed in the annulus between the sliding valve and the piston, the sliding valve is pushed upward.

47. The down-hole mud actuated hammer of claim 28 further comprising pressure activated shut-off means comprising:

a shut-off valve adapted to slide between a first position which closes the exhaust passage to thereby prevent exhausting of the high pressure mud in the downstroke chamber, and a second position which opens the exhaust passage;

biasing means for biasing the valve toward the first position with a predetermined biasing force;

a shut-off valve actuating chamber wherein mud from the drill string contacts at least one actuating surface to thereby create a force opposing the predetermined biasing force, said opposing force being sufficient to push said shut-off valve into said second position when the mud in the drill string possesses a predetermined pressure.

48. The down-hole mud actuated hammer of claim 47 wherein the biasing means is easily replaceable to thereby allow adjustment of the predetermined pressure at which the shut-off means is activated.

49. The down-hole mud actuated hammer of claim 47 wherein the biasing means is a precompressed spring and wherein adjustment of the predetermined pressure at which the shut-off means is activated can be made by changing the degree of precompression on the spring.

50. The down-hole mud actuated hammer of claim 47 further comprising a plurality of shut-off valve actuating pistons each having a first surface communicating with the shut-off valve actuating chamber, and a second surface at the other end communicating with a chamber supplied with high pressure mud when the shut-off valve is closed and which chamber is exhausted when the shut-off valve is open.

51. The down-hole mud actuated mud hammer of claim 50 wherein the shut-off valve actuating pistons further comprise a pin which contacts the shut-off valve.

52. The down-hole mud actuated mud hammer of claim 50 further comprising a plurality of filtering means for filtering the mud between the drill string and the shut-off valve actuating chamber.

53. The down-hole mud actuated mud hammer of claim 52 wherein the filtering means comprises a tortuous passageway through which the mud must pass to reach the shut-off valve actuating chamber.

54. The down-hole mud actuated mud hammer of claim 28 wherein the sliding valve and valve sleeve are adapted so that the sliding valve has a third position in between the first and second position wherein high pressure mud is simultaneously allowed into the downstroke chamber and allowed to be exhausted, to thereby reduce pressure transients.

55. The down-hole mud actuated hammer of claim 28 wherein the exhaust passage includes an exhaust passage section passing through the throat, which section includes an outlet near the impact surfaces on the piston and near housing exhaust ports through the housing, whereby the exhaust flows over the impact surfaces on the piston and the shank before being exhausted to the low pressure region out of the housing.

56. The down-hole mud actuated hammer of claim 28 wherein the lower end of the housing includes an upper stop which sets the maximum insertion of the shank into the housing and a lower stop which sets the minimum insertion of the shank into the housing, and wherein, when the shank is at its minimum insertion while the drill string is being lifted, the piston is allowed to move downward past the down position to an overtravel position, and further wherein, when the piston is in the overtravel position, the exhaust passage is blocked so as to prevent the piston from reciprocating.

57. The down-hole mud actuated hammer of claim 28 further comprising:

an upper stop at the lower end of the housing which sets the maximum insertion of the shank into the housing;

a lower stop at the lower end of the housing which sets the minimum insertion of the shank into the housing; and removable seal means;

wherein, when the shank is at its minimum insertion while the drill string is being lifted, the piston is allowed to move downward past the down position to an overtravel position; and wherein, when the piston is in the overtravel position, and when the removable seal is in place, the exhaust passage is blocked so as to prevent the piston from reciprocating.

58. The down-hole mud actuated hammer of claim 57 wherein when the removable seal is not in place, the piston is allowed to reciprocate without striking the shank.

59. The down-hole mud actuated hammer of claim 28 wherein all of the mud exhausted from the downstroke chamber is caused to pass between the impact surfaces of the shank and the impact surfaces of the piston before being exhausted to the low pressure region out of the housing.

* * * * *